US008646286B2

(12) United States Patent
Scherer et al.

(10) Patent No.: US 8,646,286 B2
(45) Date of Patent: Feb. 11, 2014

(54) REFRIGERATION SYSTEM CONTROLLED BY REFRIGERANT QUALITY WITHIN EVAPORATOR

(75) Inventors: John Scherer, Santa Monica, CA (US); Ralph Tator, Las Vegas, NV (US)

(73) Assignee: PDX Technologies LLC, Houston, TX (US)

( * ) Notice: Subject to any disclaimer, the term of this patent is extended or adjusted under 35 U.S.C. 154(b) by 0 days.

(21) Appl. No.: 13/312,706

(22) Filed: Dec. 6, 2011

(65) Prior Publication Data

US 2013/0086930 A1 Apr. 11, 2013

Related U.S. Application Data

(60) Provisional application No. 61/428,576, filed on Dec. 30, 2010.

(51) Int. Cl.
*F25B 41/04* (2006.01)
*F25B 41/00* (2006.01)

(52) U.S. Cl.
USPC ..... 62/222; 62/216; 62/513

(58) Field of Classification Search
USPC ..... 62/216, 222, 504, 513, 525
See application file for complete search history.

(56) References Cited

U.S. PATENT DOCUMENTS

| | | | | |
|---|---|---|---|---|
| 2,707,868 A | | 5/1955 | Goodman | |
| 3,041,843 A | | 7/1962 | Swearingen, et al. | |
| 3,170,302 A | | 2/1965 | Potito | |
| 4,370,868 A | * | 2/1983 | Kim et al. | 62/504 |
| 4,577,468 A | | 3/1986 | Nunn, Jr. et al. | |
| 4,683,726 A | * | 8/1987 | Barron | 62/503 |
| 4,901,533 A | | 2/1990 | Fan et al. | |
| 5,139,548 A | | 8/1992 | Liu et al. | |
| 6,026,804 A | * | 2/2000 | Schardt et al. | 126/344 |
| 6,199,401 B1 | * | 3/2001 | Haussmann | 62/525 |
| 6,923,011 B2 | | 8/2005 | Manole | |
| 7,000,413 B2 | * | 2/2006 | Chen et al. | 62/225 |

(Continued)

FOREIGN PATENT DOCUMENTS

| | | |
|---|---|---|
| JP | 2002286307 | 3/2002 |
| JP | 2005291622 | 10/2005 |
| JP | 2007198664 | 9/2007 |
| WO | WO2006112157 | 10/2006 |

OTHER PUBLICATIONS

International Search Report and Written Opinion dated Apr. 10, 2012 in PCT/US2011/067390.

*Primary Examiner* — Mohammad M Ali
*Assistant Examiner* — Daniel C Comings
(74) *Attorney, Agent, or Firm* — Sheldon Mak & Anderson PC; Denton L. Anderson; Jeffrey G. Sheldon

(57) ABSTRACT

A method of controlling a refrigeration system having a refrigerant disposed within a fluid-tight circulation loop with a compressor, a condenser and an evaporator, wherein the method includes the steps of (a) compressing refrigerant in a gaseous state within the compressor and cooling the refrigerant within the condenser to yield refrigerant in the liquefied state; (b) flowing refrigerant from the condenser into the evaporator, wherein the refrigerant partially exists in a two-phase state; (c) flowing refrigerant from the evaporator to the compressor; (d) repeating steps (a)-(c); (e) detecting the condition of the refrigerant with a sensor disposed within the evaporator upstream of the outlet opening; and (f) controlling the flow of refrigerant to the evaporator in step (b) based upon the detected condition.

30 Claims, 19 Drawing Sheets

(56) References Cited

U.S. PATENT DOCUMENTS

2006/0117767 A1* 6/2006 Mowris ..... 62/149
2007/0084594 A1 4/2007 Higashiyama
2008/0314064 A1 12/2008 Al-Eidan
2010/0132399 A1 6/2010 Mitra et al.

* cited by examiner

REFRIGERATION SYSTEM CONTROLLED BY REFRIGERANT QUALITY WITHIN EVAPORATOR

FIELD OF THE INVENTION

This invention relates generally to refrigeration systems and, more particularly, to refrigeration systems comprising a compressor, a condenser and an evaporator.

BACKGROUND OF THE INVENTION

Refrigeration systems comprising a compressor, a condenser and an evaporator come in a wide variety of configurations. The most common of these configurations is generally termed a "direct expansion system." In a direct expansion system, a refrigerant vapor is pressurized in the compressor, liquified in the condenser and allowed to revaporize in the evaporator and then flowed back to the compressor.

In direct expansion systems, the amount of superheat in the refrigerant vapor exiting the evaporator is almost exclusively used as a control parameter. Direct expansion systems operate with approximately 20% to 30% of the evaporator in the dry condition to develop superheat. A problem with this control method is that superheat control is negatively effected by close temperature differences, wide fin spacing or pitch, light loads and water content. The evaporator must be 20% to 30% larger for equivalent surface to be available. Also, superheat control does not perform well in low-temperature systems, such as systems using ammonia or similar refrigerant, wherein the evaporator temperatures are about 0° F.

An additional disadvantage of the superheat control method is that it tends to result in excessive inlet flashing. Such inlet flashing results in pressure drop and instability transfer within the evaporator, and results in the forcible expansion of liquid out of the distal ends of the evaporator coils. Also, this control method is especially problematic when the refrigerant is ammonia or other low-temperature refrigerant, because so much liquid refrigerant is typically expelled from the evaporator to require the use of large liquid traps downstream of the evaporator. Thus, in all superheat controlled expansion systems, negative compromises are necessarily made in efficiency and capacity.

Accordingly, there is a need for a refrigeration system which eliminates the aforementioned problems in the prior art.

SUMMARY OF THE INVENTION

The invention satisfies this need. The invention is a method of controlling a refrigeration system, wherein the refrigeration system comprises a refrigerant disposed within a fluid-tight circulation loop including a compressor, a condenser and an evaporator, the refrigerant being capable of existing in a liquified state, a gaseous state and a two-phase state comprising both refrigerant in the liquified state and refrigerant in the gaseous state, the evaporator having an upstream section with an inlet opening and a downstream section with an outlet opening, the method comprising (a) compressing refrigerant in a gaseous state within the compressor and cooling the refrigerant within the condenser to yield refrigerant in a liquified state; (b) flowing the refrigerant in a liquified state into the evaporator; (c) reducing the pressure of the refrigerant within the evaporator to yield refrigerant in a two-phase state; (d) reducing the pressure of the refrigerant in a two-phase state within the evaporator to yield a refrigerant in a gaseous state; (e) flowing refrigerant in a gaseous state from the evaporator to the compressor; (f) repeating steps (a)-(e); and (g) controlling the flow of refrigerant in a liquid state to the evaporator in step (b) based upon the condition of the refrigerant within the evaporator upstream of the outlet opening.

The invention is also a refrigeration system capable of carrying out the above-described method. The refrigeration system of the invention comprises (a) a fluid tight circulation loop including a compressor, a condenser and an evaporator, the circulating loop being configured to continuously circulate a refrigerant which is capable of existing in a liquified state, a gaseous state and a two-phase state comprising both refrigerant in the liquified state and refrigerant in the gaseous state, the evaporator having an upstream section with an inlet opening and a downstream section with an outlet opening, the circulation loop being further configured to (i) compress refrigerant in a gaseous state within the compressor and cool the refrigerant in the condenser to yield refrigerant in a liquified state; (ii) flow the refrigerant in a liquified state into the evaporator; (iii) reduce the pressure of the refrigerant within the evaporator to yield refrigerant in a two-phase state; (iv) reduce the pressure of the refrigerant in a two-phase state within the evaporator to yield a refrigerant in a gaseous state; (v) flow refrigerant in a gaseous state from the evaporator to the compressor; and (vi) repeat steps (i)-(v); and (b) a controller for controlling the flow of refrigerant in a liquid state to the evaporator based upon the condition of the refrigerant within the evaporator upstream of the outlet opening.

DRAWINGS

These and other features, aspects and advantages of the present invention will become better understood with reference to the following description, appended claims and accompanying drawings where:

DETAILED DESCRIPTION OF THE INVENTION

Figure 1:
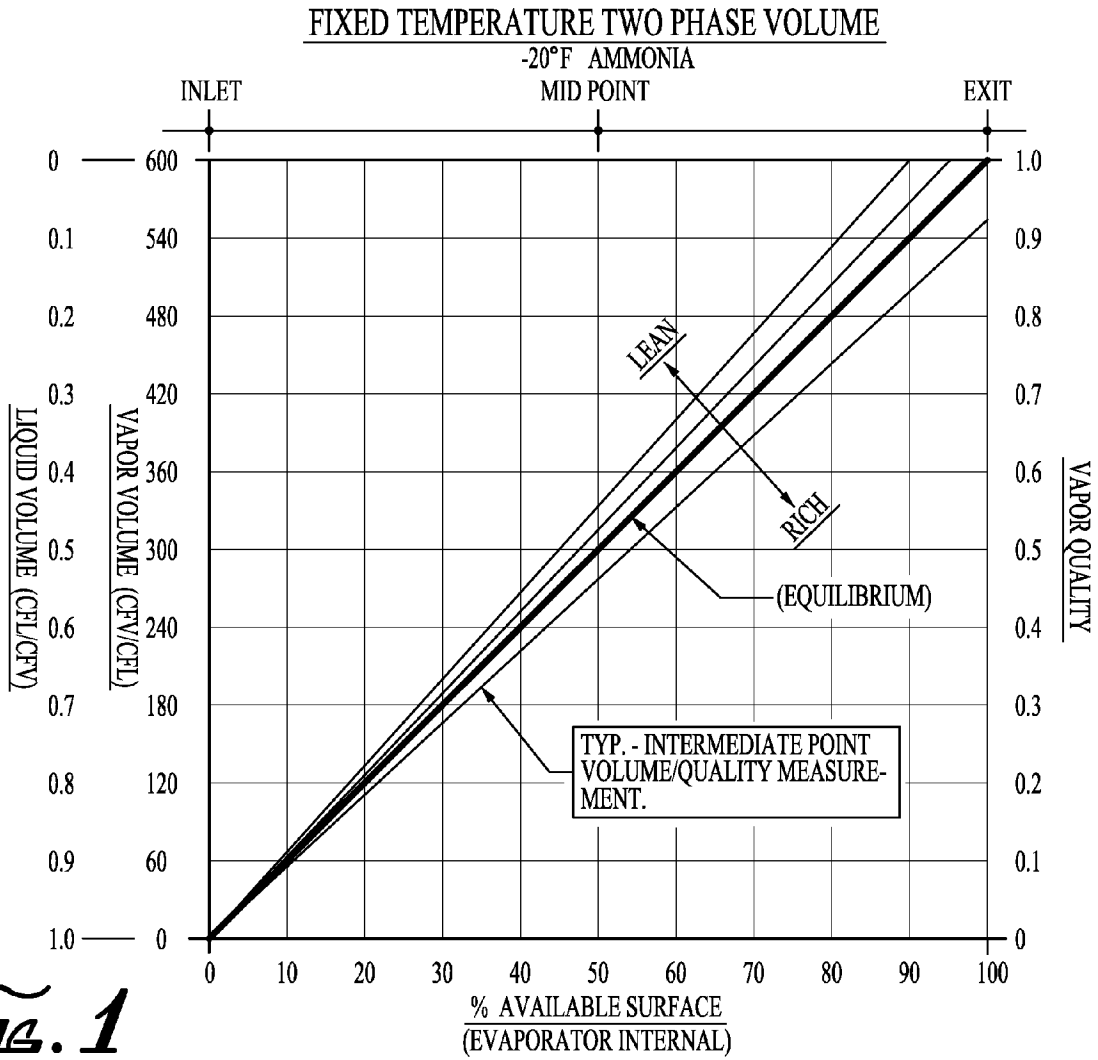
FIG. 1 is a diagram illustrating typical fixed temperature two-phase volume characteristics of refrigerant passing through an evaporator within a refrigeration system having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

As noted above, the invention is a method of controlling a refrigeration system, wherein the refrigeration system comprises a refrigerant disposed within a fluid-tight circulation loop including a compressor, a condenser and an evaporator, the refrigerant being capable of existing in a liquified state, a gaseous state and a two-phase state comprising both refrigerant in the liquified state and refrigerant in the gaseous state, the evaporator having an upstream section with an inlet opening and a downstream section with an outlet opening, the method comprising (a) compressing refrigerant in a gaseous state within the compressor and cooling the refrigerant within the condenser to yield refrigerant in a liquified state; (b) flowing the refrigerant in a liquified state into the evaporator; (c) reducing the pressure of the refrigerant within the evaporator to yield refrigerant in a two-phase state; (d) reducing the pressure of the refrigerant in a two-phase state within the evaporator to yield a refrigerant in a gaseous state; (e) flowing refrigerant in a gaseous state from the evaporator to the compressor; (f) repeating steps (a)-(e); and (g) controlling the flow of refrigerant in a liquid state to the evaporator in step (b) based upon the condition of the refrigerant within the evaporator upstream of the outlet opening.

Typically, the controlling of the flow of refrigerant in a liquid state to the evaporator in step (g) is based upon the quality of the refrigerant within the evaporator. That is, the controlling of the flow of refrigerant in a liquid state to the evaporator is based upon the ratio of the volume of vapor to the volume of liquid in the refrigerant. Quality can be determined by directly measuring vapor-to-liquid volume ratios. Quality can also be determined by many other means known in the art, including capacitance, heating element corresponding current draw, calibrated mass flow sensors and vortex flow sensors.

In embodiments directly measuring two-phase volume to liquid injection volume ratios, one to three measuring points are typically employed, at least one of them preferably being at an intermediate point within the evaporator. As used herein, the term "intermediate point" is a point within the evaporator, downstream of the inlet opening a distance encompassing 50-90% of the total evaporator circuit length, typically 60%-80% of the evaporator circuit length. In many applications, a plurality of spaced-apart intermediate points can be used in measuring the two-phase volume-to-liquid injection volume ratios.

Where quality of the refrigerant is determined by measurement at a single point, that single point is preferably a single intermediate point. After measurement at the intermediate point, it is often advantageous for the controller to extrapolate from the value sensed at the intermediate point to approximate the liquid feed rate required to wet at least most of the entire surface.

Where quality of the refrigerant is determined by measurement at a pair of intermediate points, the controller typically interpolates between the values sensed at the intermediate points to establish the desired feed rate to wet at least most of the entire core surface.

Where quality of the refrigerant is determined by measurements at three points, the three points preferably include measurement at two intermediate points. The third "measurement point" is one or more parameters regarding the evaporator outlet or, preferably, of the feed stream of liquid refrigerant to the evaporator—such as volume or mass flow rate. By use of such three measurement control methods, the controller can take proactive steps in controlling liquid feed rate to the evaporator before entry of refrigerant to the evaporator coils. Feed rate can be governed so as to not overshoot a predetermined range. Also, the incoming feed rate, together with the intermediate point and outlet point measurements, allow the control system to differentiate between large and small loads. This is important because the intermediate point measurement value can vary with varying feed rates.

The controller can also use input regarding vapor quality to control the flow of refrigerant to the evaporator. Vapor quality can be determined by various methods known in the art, including void fraction determination, capacitance, specially calibrated mass flow sensors, heating element based refrigeration quality sensors, etc.

Exit vapor temperature measurement can also be used by the controller to control the flow of refrigerant to the evaporator. This means it is superheat controlled direct expansion.

Controlling the flow of refrigerant to the evaporator in the above-described manner allows the controller to modulate liquid injection to the evaporator such that the entire internal surface to be wetted with very little refrigerant mass, and such that virtually no refrigerant liquid evaporation occurs outside the evaporator.

FIG. 1 is a liquid-to-vapor volume/quality graph for a fixed temperature two-phase volume, illustrating the type of information received and processed by the controller in the method of the invention. The intermediate point location is chosen at the 50% of available surface point within the evaporator. Points above the equilibrium line indicate that the system is operating in the lean range. Points below the equilibrium line indicate that the system is operating in a rich regime. Points along the equilibrium line are, of course, at equilibrium.

In a preferred embodiment of the invention, refrigerant in a liquified state from step (a) is precooled prior to being flowed into the evaporator in step (b). Typically, refrigerant in a liquified state from step (a) is precooled to near its boiling point, such as between 0° F. and 60° F. of its boiling point at the pressure of the refrigerant at the inlet opening of the evaporator, preferably between 0° F. and 30° F. of its boiling point at the pressure of the refrigerant at the inlet opening of the evaporator and most preferably between 0° F. and 5° F.

The value of precooling the refrigerant to the evaporator stems from the reduction or elimination of flash vapor at the evaporator inlet. Reducing flash vapor at the evaporator inlet stabilizes and makes more uniform the expansion of the refrigerant after entry into the evaporator. Between 15% and 30% or more of the refrigeration load in an evaporator of non-precooled refrigeration systems is flash gas. Such flash gas decreases evaporator efficiency and tends to blow liquid out of the outlet opening of the evaporator.

Moreover, efficiency of the overall cycle is significantly increased in precooled refrigerant systems through the removal of a superheat requirement. Still further, particularly within ammonia systems, the evaporator surface required in the evaporator is significantly reduced by use of a precooler. Yet still further, pressure drop across the evaporator inlet opening is typically reduced by as much as about 20% in precooled refrigeration systems. Thus, the combination of the above benefits allows refrigeration systems having a precooler to operate more consistently, dependably and efficiently than refrigeration systems having no precooler. Disposing the precooler internally is an important option in the invention. External precooling (using precooling systems and feed control systems disposed exterior of the evaporator) is known in the prior art. With internal precooling accomplished at or after the intermediate point, excess liquid in the two-phase flow is eliminated, thus balancing the overall flow while maintaining the precooling benefits.

In one embodiment of the invention, refrigerant in a liquified state from step (a) is conveniently precooled by thermal contact with refrigerant flowing within the evaporator past an intermediate sampling location.

In many applications, it may be preferable to configure one or more of the lengths of tubing within the evaporator, most preferably, each length of tubing within the evaporator, with an expanding cross-section. Typically, the expansion of the cross-section is smooth and continuous.

Figure 2:
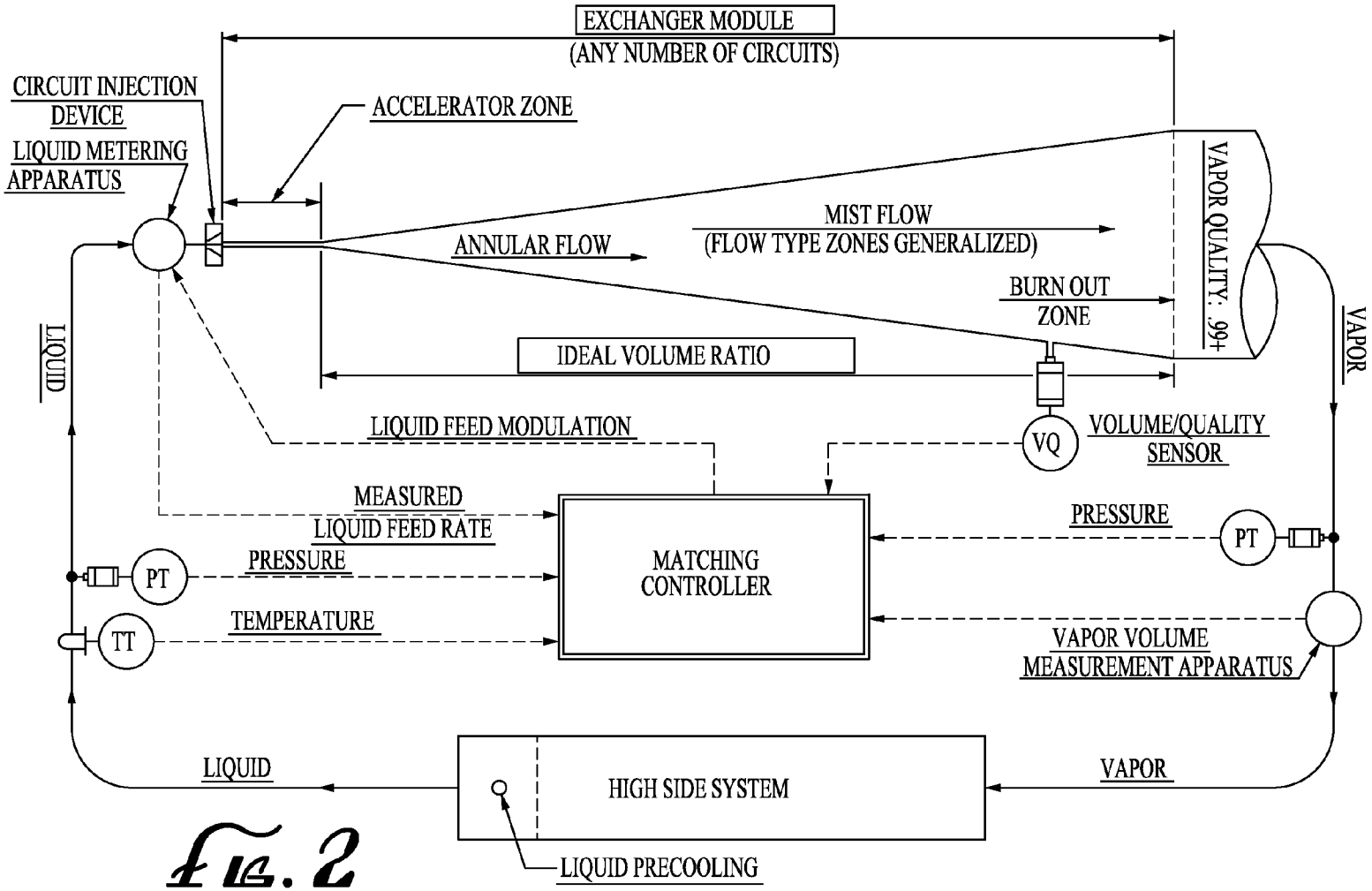
FIG. 2 is a diagram illustrating ideal theoretical velocity and pressure drop through the evaporator circuit illustrated in FIG. 3.

FIG. 2 illustrates the method the invention carried out with ideal theoretical pressure drop to velocity circuits throughout the evaporator. The refrigerant liquid feed is controlled using the controller. The controller obtains multiple data inputs. The controller output provides feed command signals to modulate supply liquid to provide fully wetted evaporated internal surfaces, with little or no refrigerant evaporation outside of the evaporator. Overall pressure drops remains favorable due to removal of flash gas flowing through the entire circuit. Average pressure drop in the evaporator is preferably limited to 0.5 psi for low temperature duty, and one psi for medium temperature applications.

As noted above, prior art ammonia refrigeration systems typically require suction accumulators to catch liquid carry-over from the evaporator. The method of the invention, on the other hand, is capable of controlling the feed so accurately the feed rate to the evaporator so accurately that such suction accumulators can be markedly reduced in size or eliminated altogether.

The invention is also a refrigeration system used in the method of the invention. The refrigeration system 10 comprises (a) a fluid tight circulation loop 12 including a compressor 14, a condenser 16 and an evaporator 18, the circulation loop 12 being configured to continuously circulate a refrigerant which is capable of existing in a liquified state, a gaseous state and a two-phase state comprising both refrigerant in the liquified state and refrigerant in the gaseous state, the evaporator 18 having an upstream section 20 with an inlet opening 22 and a downstream section 24 with an outlet opening 26, the circulation loop 12 being further configured to (i) compress refrigerant in a gaseous state within the compressor 14 and cool the refrigerant in the condenser 16 to yield refrigerant in a liquified state; (ii) flow the refrigerant in a liquified state into the evaporator 18; (iii) reduce the pressure of the refrigerant within the evaporator 18 to yield refrigerant in a two-phase state; (iv) reduce the pressure of the refrigerant in a two-phase state within the evaporator 18 to yield a refrigerant in a gaseous state; (v) flow refrigerant in a gaseous state from the evaporator 18 to the compressor 14; and (vi) repeat steps (i)-(v); and (b) a controller 27 for controlling the flow of refrigerant in a liquid state to the evaporator 18 based upon the condition of the refrigerant within the evaporator 18, upstream of the outlet opening 26.

Figure 3:
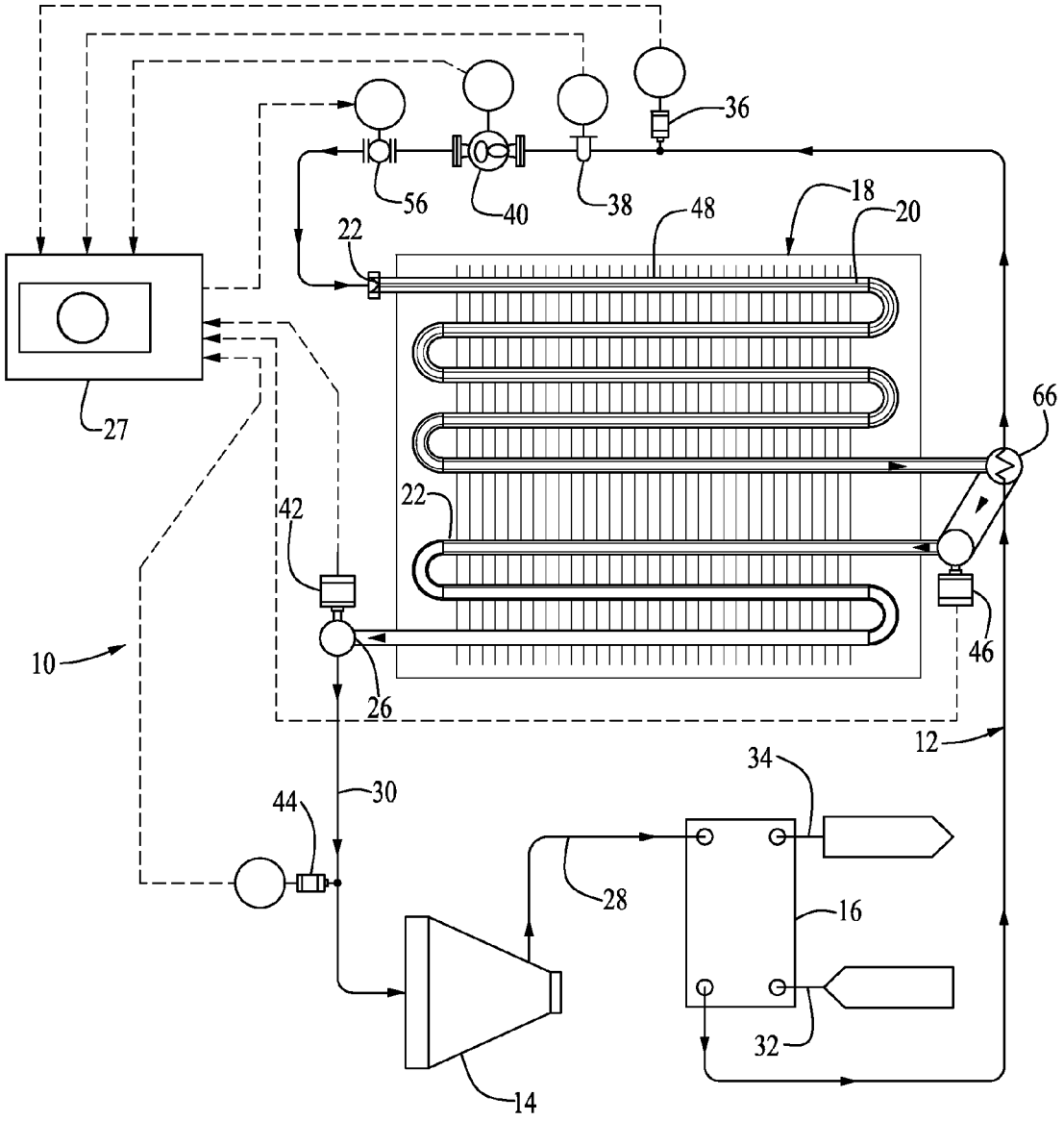
FIG. 3 is a flow diagram of a refrigeration system having features of the invention.

An example of the refrigeration system 10 of the invention is illustrated in FIG. 3. As can be seen in FIG. 3, a supply conduit 28 is provided to carry refrigerant from the compressor 14, through the condenser 16 and into the evaporator 18. A return conduit 30 is provided to carry refrigerant in the gaseous state from the evaporator 18 back to the compressor 14.

In the embodiment illustrated in FIG. 3, the condenser 16 is a plate condenser using cooling water from a cooling water input line 32 connected to a supply of cooling water. Cooling water within the condenser 16 is returned to the supply of cooling water via a cooling water discharge line 34. Other condenser types can also be used in the invention.

Also in the embodiment illustrated in FIG. 3, the controller 27 is a matching controller, receiving input information from a liquid pressure sensor 36, a liquid temperature sensor 38 and a liquid flow sensor 40 disposed within the supply conduit 28. The controller 27 also receives input information from a vapor flow sensor 42, a vapor pressure sensor 44 (both disposed within the return conduit 30) and an intermediate point refrigeration condition sensor 46.

In the refrigeration system 10 illustrated in FIG. 3, the evaporator 18 is a finned tube type evaporator. Other evaporator types useable in the invention include, but are not limited to, plate and frame evaporators, double pipe evaporators, shell and plate evaporators, mini-channel evaporators and micro-channel evaporators.

In the evaporator 18 illustrated in FIG. 3, refrigerant is expanded within a plurality of parallel tube circuits 48. Refrigerant input to the evaporator 18 typically flows initially into a distributor header 50 which, in turn, feeds each of the circuits 48. Each circuit 48 flows into a collection header 52 wherein all of the refrigerant is gathered and directed to the evaporator outlet opening 26. The fluid to be cooled in the evaporator 18 typically flows around the outside of the tube circuits 48. For greater thermal contacting area, it is common for the exterior of all of the tube circuits 48 to comprise a multiplicity of spaced-apart exterior fins.

Most commonly, the fluid to be cooled is a gas, typically air. However, liquid fluids to be cooled can also be employed in the invention, such as, but not limited to, water, brine, liquified carbon dioxide and glycol-water solutions.

The most straightforward method of controlling the flow of liquid refrigerant to the evaporator 18 in the refrigeration system 10 of the invention is a single point measurement method wherein the single point is taken at an intermediate point of one or more representative circuits. Control of all circuits 48 is then based on these readings. As noted above, an attractive option, particularly for low-temperature and larger applications, is combining intermediate point refrigerant condition measurements with evaporator inlet flow rate. Whichever method is selected, exit vapor condition is typically also measured.

As illustrated in FIG. 3, another preferred embodiment of the invention includes the use of a precooler 66 for precooling refrigerant flowed within the supply conduit 28 to the evaporator 18. In the embodiment illustrated in FIG. 3, refrigerant flowing through the supply conduit 28 is brought into thermal contact with refrigerant from within the evaporator 18 in the precooler 66. In the embodiment illustrated in FIG. 3, the refrigerant from within the evaporator 18 is conveniently also used to provide input information to the controller 27 regarding the condition of the refrigerant within the evaporator 18 via an intermediate point refrigerant condition sensor 46 disposed within the line circulating refrigerant from the evaporator 18 to the precooler 66.

Figure 4:
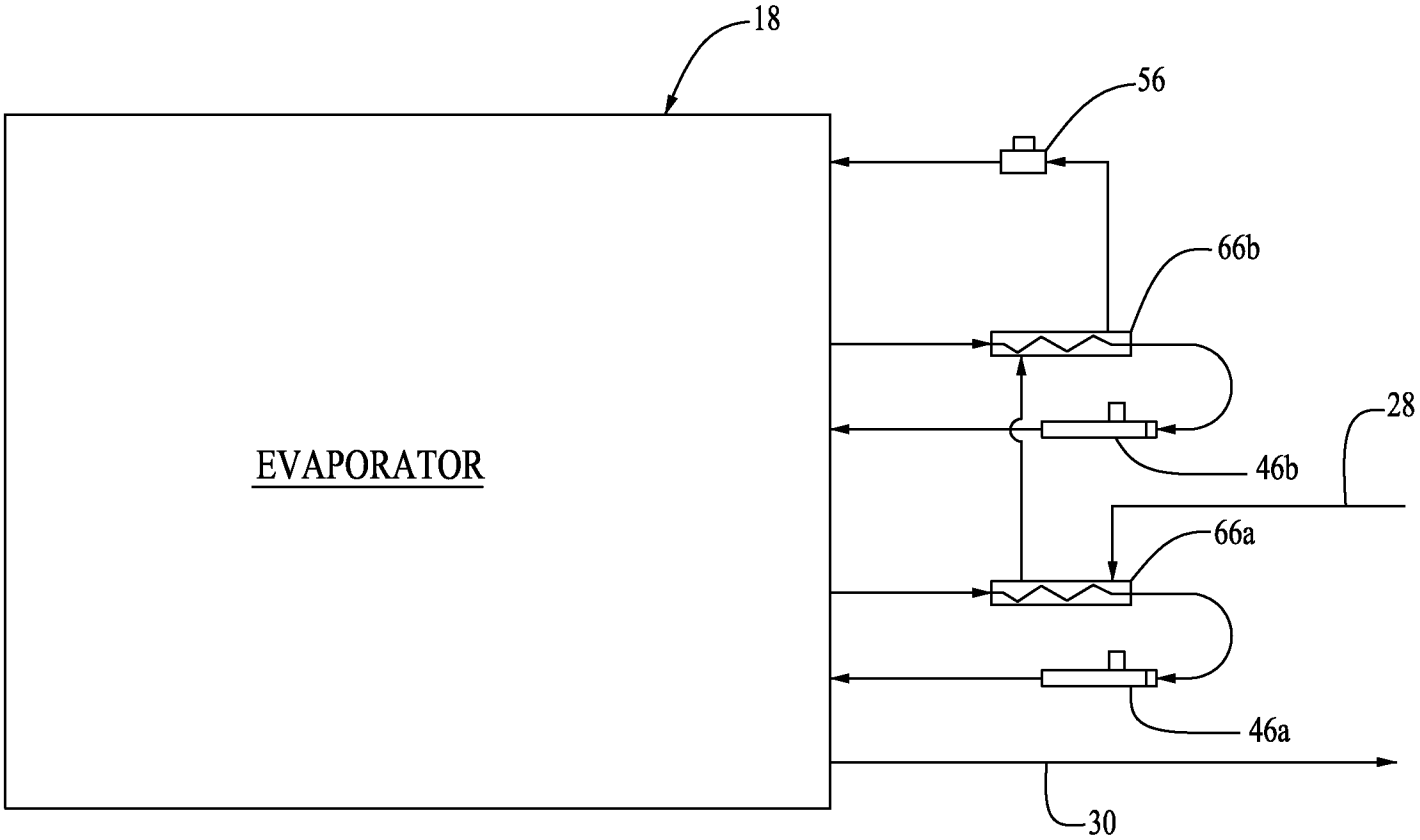
FIG. 4 is a diagram for a portion of an alternative refrigeration system having features of the invention.

FIG. 4 illustrates an alternative flow scheme wherein a pair of precoolers 66*a* and 66*b* are employed. Each precooler 66*a* or 66*b* uses as coolant refrigerant taken from different intermediate points within the evaporator 18. Within the line circulating refrigerant to the first precooler 66*a* is a first intermediate point refrigerant condition sensor 46*a*, and within the second precooler 66*b* is a second intermediate point refrigerant condition sensor 46*b*.

Figure 5:
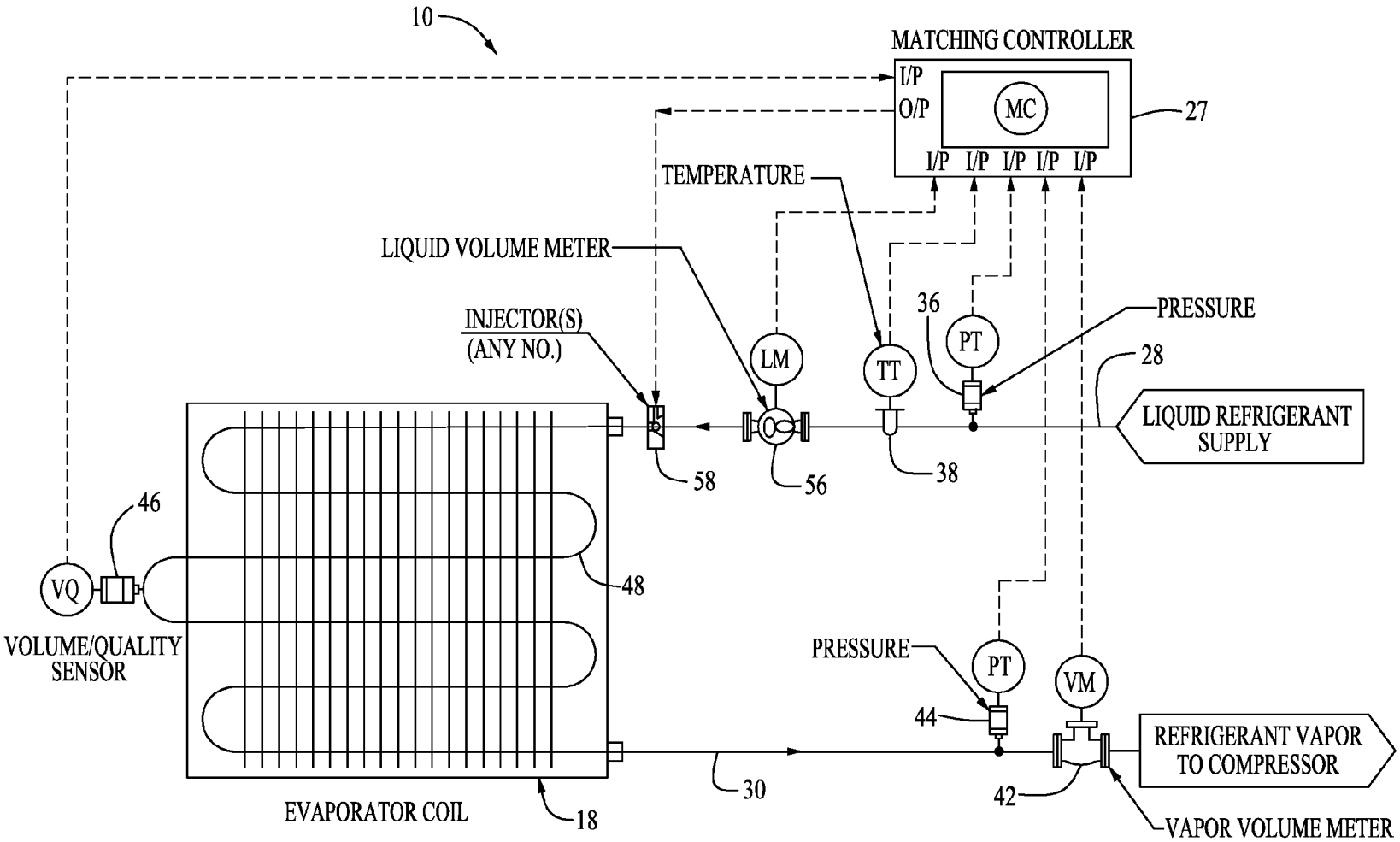
FIG. 5 is a flow diagram for a portion of a refrigeration system having features of the invention and having electronic individual circuit liquid feed injection.

In FIG. 3, the controller 27 controls the flow of input liquid refrigerant to the evaporator 18 by regulating a feed inlet motor-operated control valve 56 disposed upstream of the evaporator 18. FIGS. 5-8 illustrate alternative systems for controlling the flow input of liquid refrigerant to the evaporator 18. In FIG. 5, the control of flow of liquid refrigerant to the evaporator 18 uses an electronic individual circuit feed injection system. Each electronic injector 58 is adapted to precisely meter liquid refrigerant to the evaporator circuits 48. The controller 27 regulates flow within the supply conduit 28 by manipulating flow through the electronic injectors 58.

Figure 6:
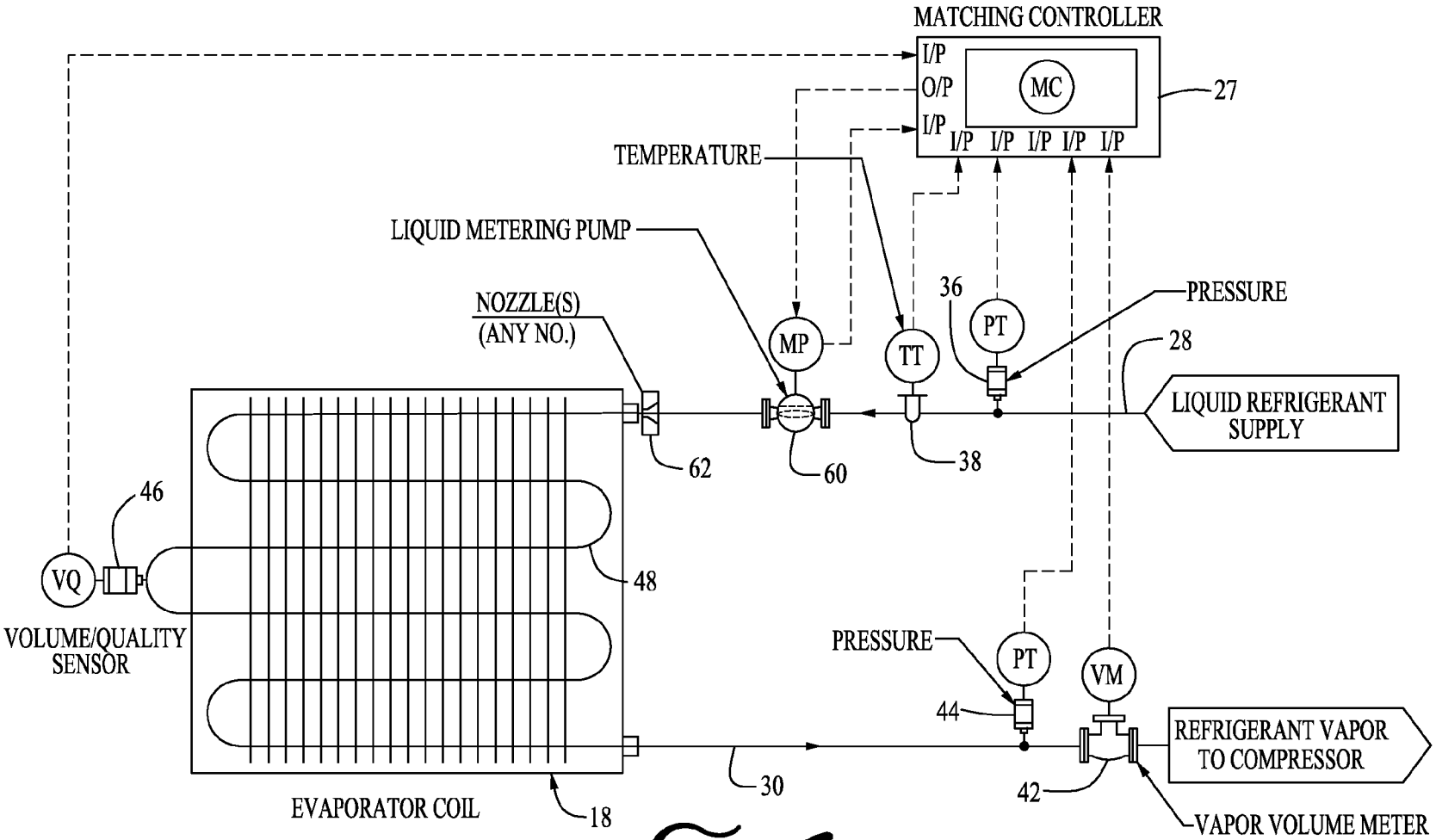
FIG. 6 is a flow diagram for a portion of a refrigeration system having features of the invention and using a liquid metering pump and circuit nozzles to feed liquid into the evaporator.

FIG. 6 illustrates an alternative system wherein the control of flow of liquid refrigerant to the evaporator 18 uses a liquid metering pump 60. In this alternative system, one or more feed nozzles 62 are employed, although the controller 27 does not manipulate such feed nozzles 62. Precision feed nozzles 62 are preferred for delivery of liquid into the evaporator circuits 48. With precision feed nozzles 62, precooled liquid at or near the evaporator saturated suction temperature will not flash between the control valve 56 and feed nozzles 62. Control operating pressure can be varied to match a wide range of loading with a high level of accuracy and uniformity. Electronic individual circuit liquid injection can also be employed.

Figure 7:
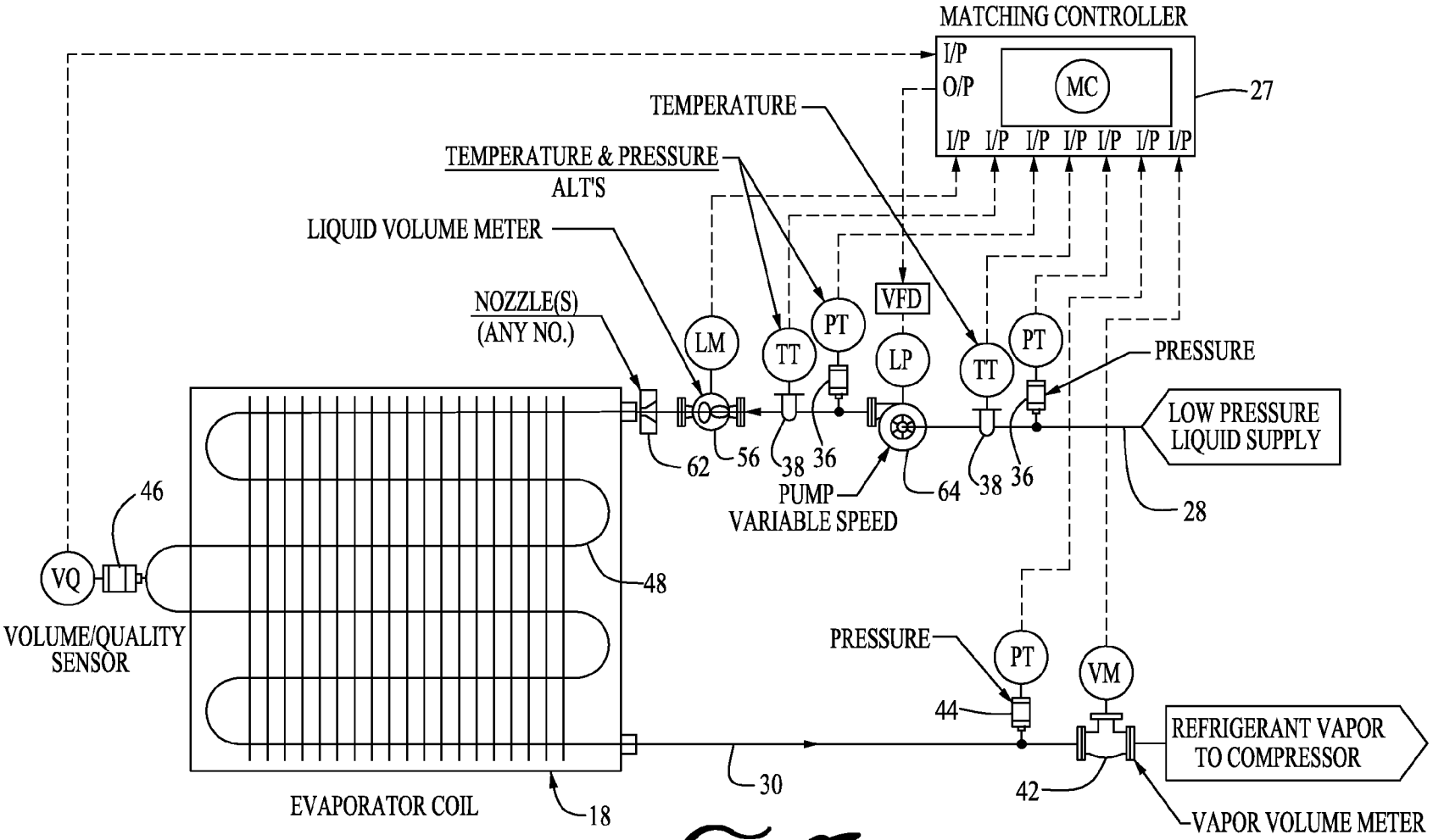
FIG. 7 is a flow diagram for a portion of a refrigeration system having features of the invention and using a variable speed pump and liquid volume meter.

FIG. 7 illustrates yet another alternative system. In this alternative system, input information from a liquid flow sensor 56 is also provided to the controller 27, and the controller 27 controls flow of liquid refrigerant through the supply conduit 28 via a variable speed liquid pump 64.

Figure 8:
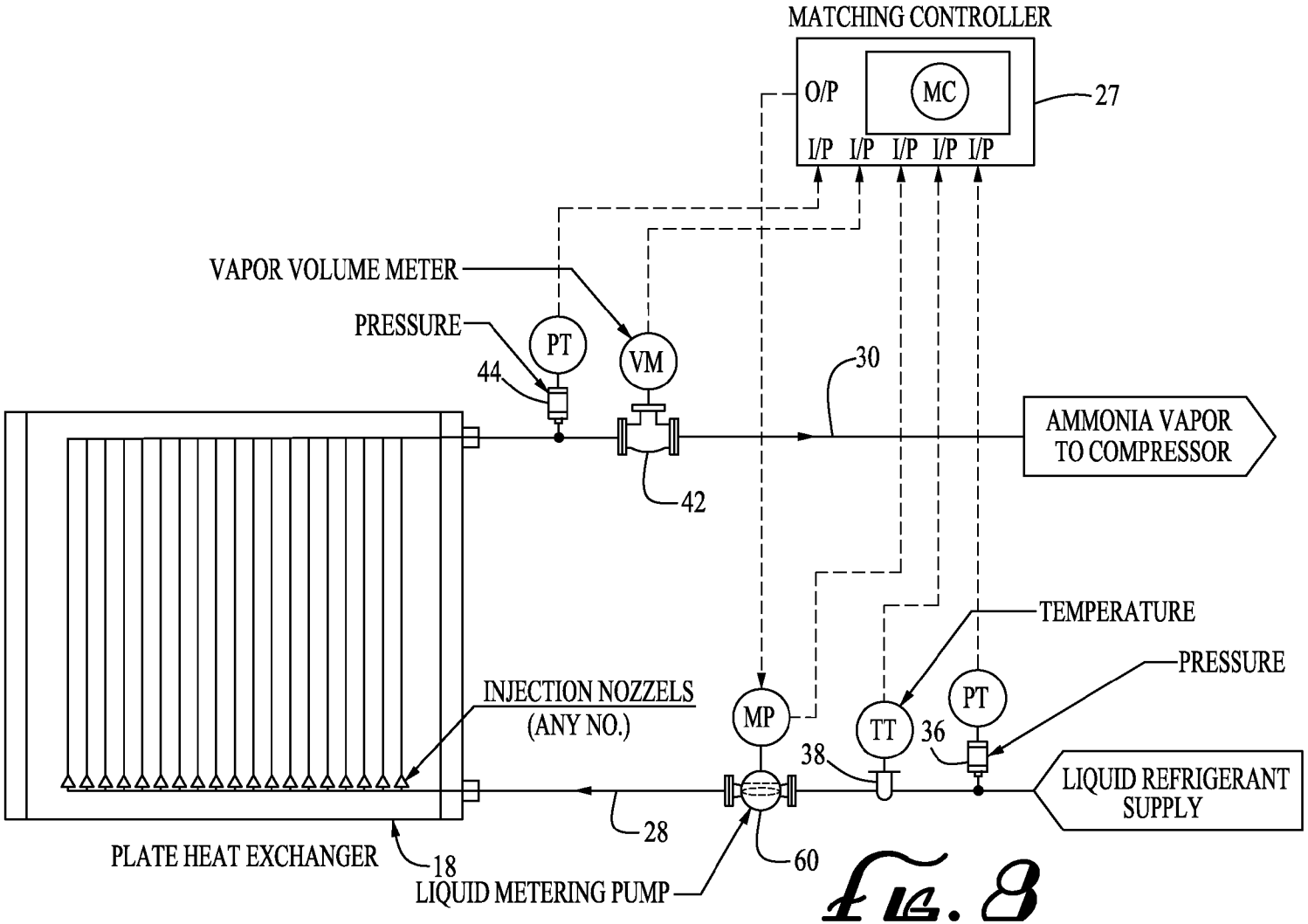
FIG. 8 is a flow diagram for a portion of a refrigeration system having features of the invention and using a plate and from evaporator.

FIG. 8 illustrates the use of a control system in a plate and frame evaporator 18 wherein flash cooled liquid at the saturated suction pressure is supplied. As in the system illustrated in FIG. 6, the flow of liquid refrigerant to the evaporator 18 is controlled by a liquid metering pump 60.

Figure 9:
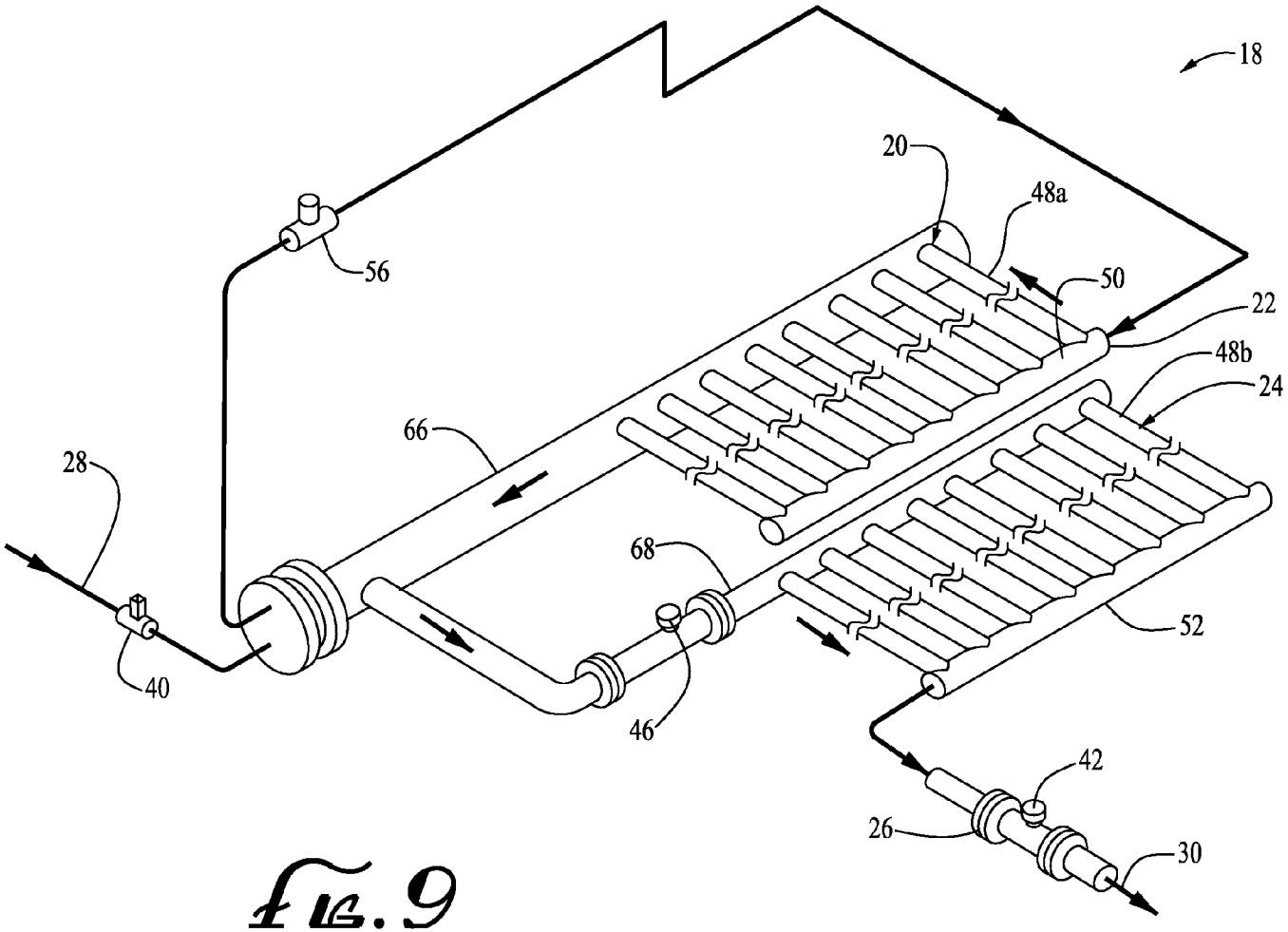
FIG. 9 is a perspective schematic view of an evaporator useable in a refrigeration system having features of the invention.

In conventional evaporators 18 comprising a plurality of circuits 48 disposed in parallel, control of flow of refrigerant in a liquid state to the evaporator 18 is based upon the condition of the refrigerant in one or more representative circuits 48 within the evaporator 18. FIG. 9 illustrates a preferred embodiment of the invention wherein the upstream section 20 of the evaporator 18 comprises a plurality of upstream circuits 48*a* and the downstream section 24 comprises a plurality of downstream circuits 48*b*. The upstream circuits 48*a* are connected to the downstream circuits 48*a* by a single midsection header 68. This preferred embodiment allows the output from upstream circuits 48*a* to be made uniform before distribution to the downstream circuits 48*b*. The midsection header 68, therefore, provides an ideal location for the intermediate refrigerant condition sensor 46—where so located, input information regarding the condition of the refrigerant within the evaporator 18 can be provided at a weighted average of the refrigerant condition at the discharge of the upstream 48*a* circuits.

In the embodiment illustrated in FIG. 9, warm or partially precooled liquid is provided via the supply conduit 28, past a liquid flow sensor 40 to a precooler 66. In the precooler 66, refrigerant to the evaporator 18 is precooled with two-phase refrigerant flow from inside the evaporator 18. Precooled liquid from the precooler 66 is then routed past a feed inlet control valve 56 to a supply header 50, and from the supply header 50 to the upstream opening of each upstream circuit 48*a*. The two-phase flow from each upstream circuit 48*a* flows to the precooler 66, wherein the two-phase refrigerant cools feed in the supply conduit 28. From the precooler 66, the two-phase refrigerant flows to a midsection header 68. An intermediate point refrigerant condition sensor 46 is disposed in the midsection header 68. From the midsection header 68, refrigerant is redistributed to the downstream circuits 48*b*. At the downstream ends of the downstream circuits 48*b*, the refrigerant is gathered in a collection header 52 and directed to the return conduit 30. If any liquid is sensed at the evaporator outlet vapor flow sensor 42, controller 27 commands the reduction of the feed rate supplied to the evaporator 18. Should liquid at the evaporator outlet vapor flow sensor 42 be significant, shutdown or other measures can be automatically instituted.

Advantages of the embodiment illustrated in FIG. 9 include (1) it is applicable to very low, low and medium temperatures, (2) it reduces flash gas and allows more uniform feed modulation, (3) pressure drop through much of the circuits 48 is reduced, (4) where liquid mass flow or volume is measured, feed quantities can be governed not to overshoot the rate required for a given load, (5) evaporator internal precooling of liquid supply vaporizes refrigerant and further stabilizes feed control, (6) the precooling load is accomplished by the same system that feeds the evaporator 18, (7) it allows operation without superheat disadvantages through entire temperature range, (8) requirement for suction accumulators are reduced or eliminated, and (9) a properly selected corresponding high side requires very little refrigerant charge.

Figure 10:
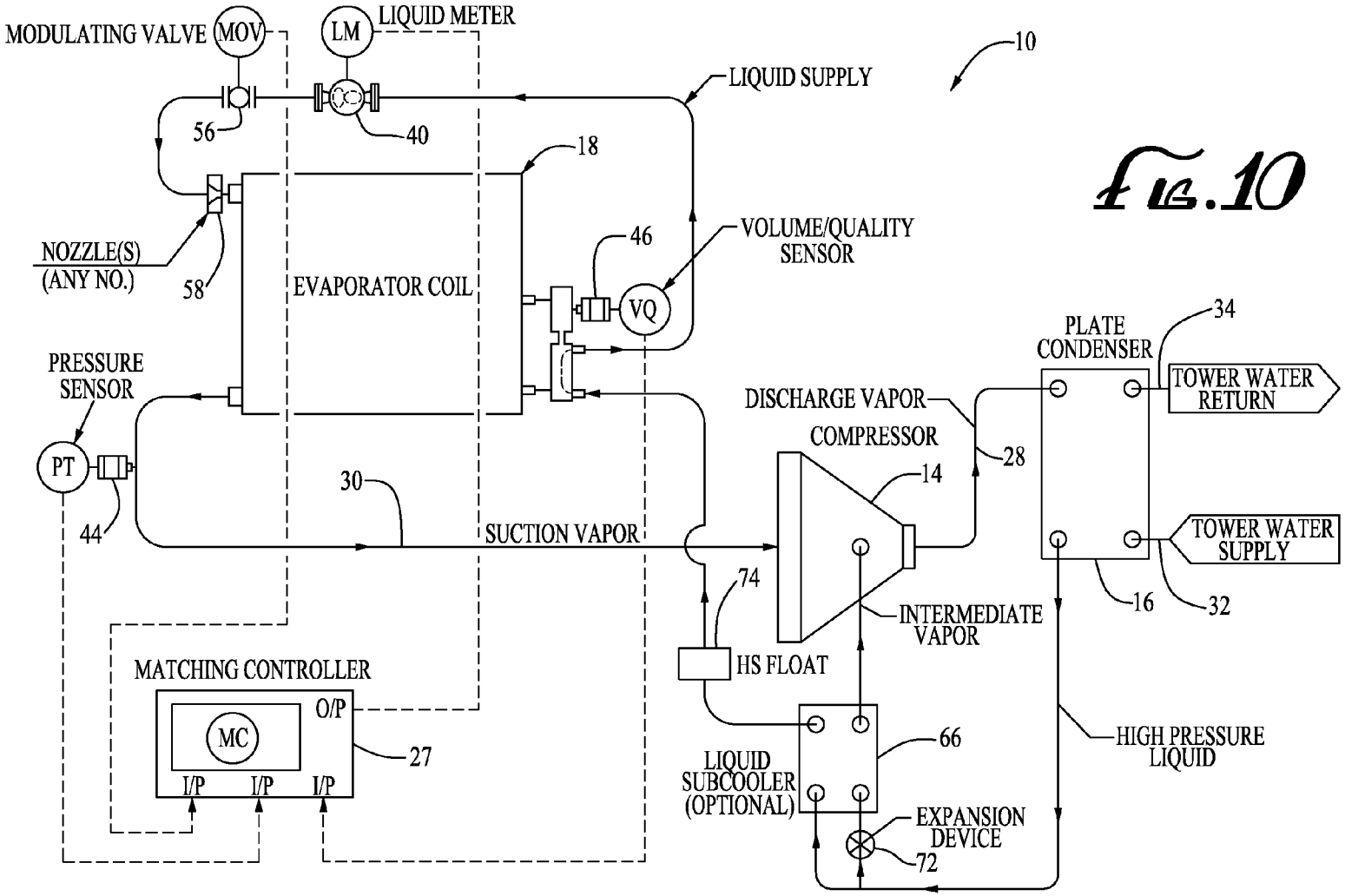
FIG. 10 is a first control diagram for a refrigeration system useable in the invention.

FIGS. 10-16 illustrate several different flow schemes useable in the invention. Each of the flow schemes illustrated in FIGS. 10-16 are directed to low and ultra low refrigeration charge package designs. FIG. 10 illustrates a flow scheme applicable for sub-cooled liquid ammonia as a refrigerant and a refrigeration system 10 of the invention having an evaporator precooler 66. FIG. 10 is configured in much the same way as the system illustrated in FIG. 3 and can be controlled by many of the methods illustrated in FIGS. 5-8. In FIG. 10, however, the precooler 66 is cooled by a portion of the refrigerant taken from the supply conduit 28 after being caused to expand through an expansion device 72. Also, a high-side float 74 is employed downstream of the precooler 66.

Figure 11:
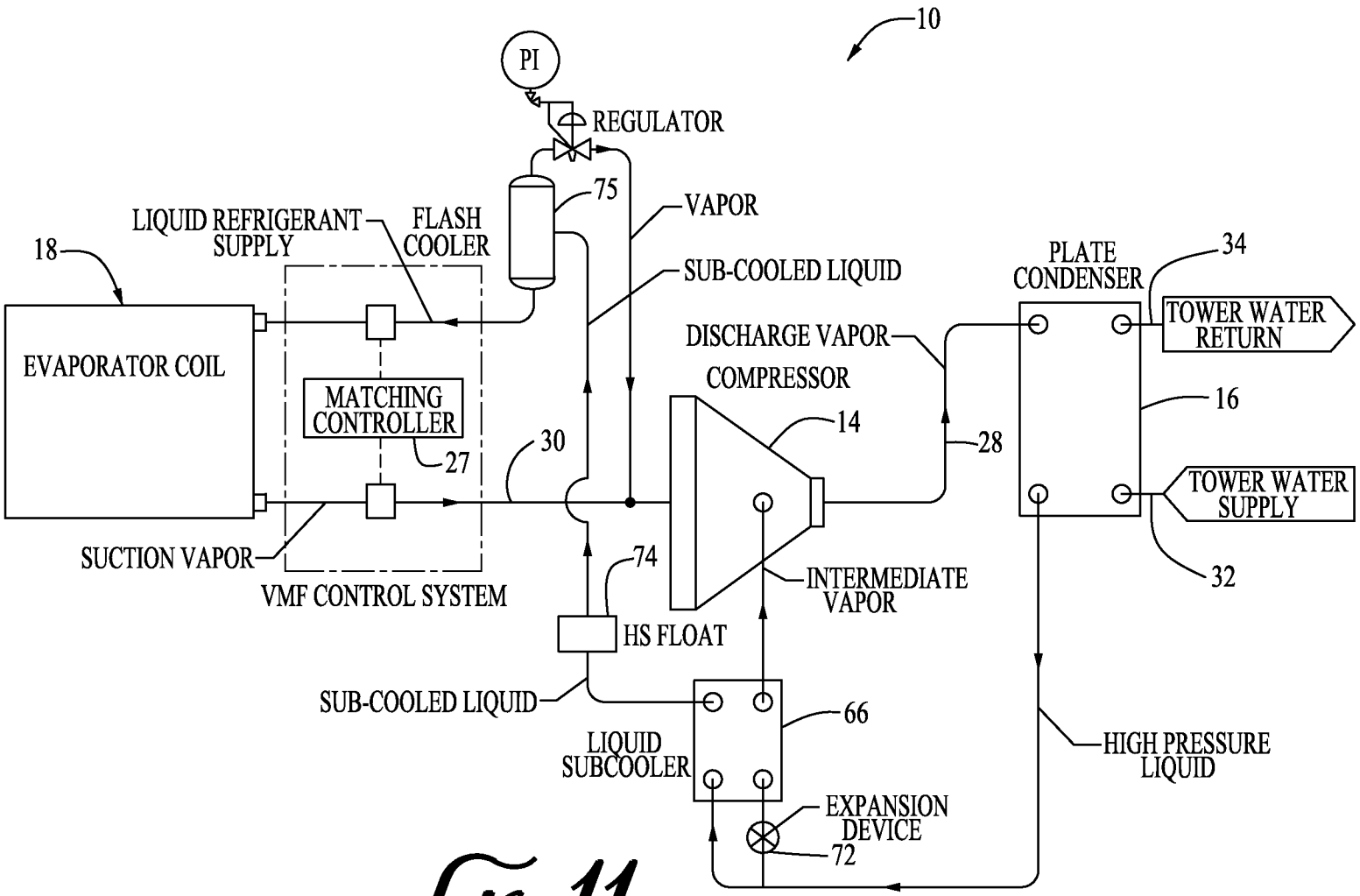
FIG. 11 is a second control diagram for a refrigeration system useable in the invention.

FIG. 11 illustrates an alternative flow scheme applicable for sub-cooled liquid ammonia as a refrigerant. This flow scheme is very similar to the scheme illustrated in FIG. 10, except that a flash cooler 75 is disposed within the supply conduit 28 downstream of the high-side float 74. Although not shown in FIG. 11, the flow scheme used in this alternative can be any of the control schemes illustrated in FIGS. 5-7.

Figure 12:
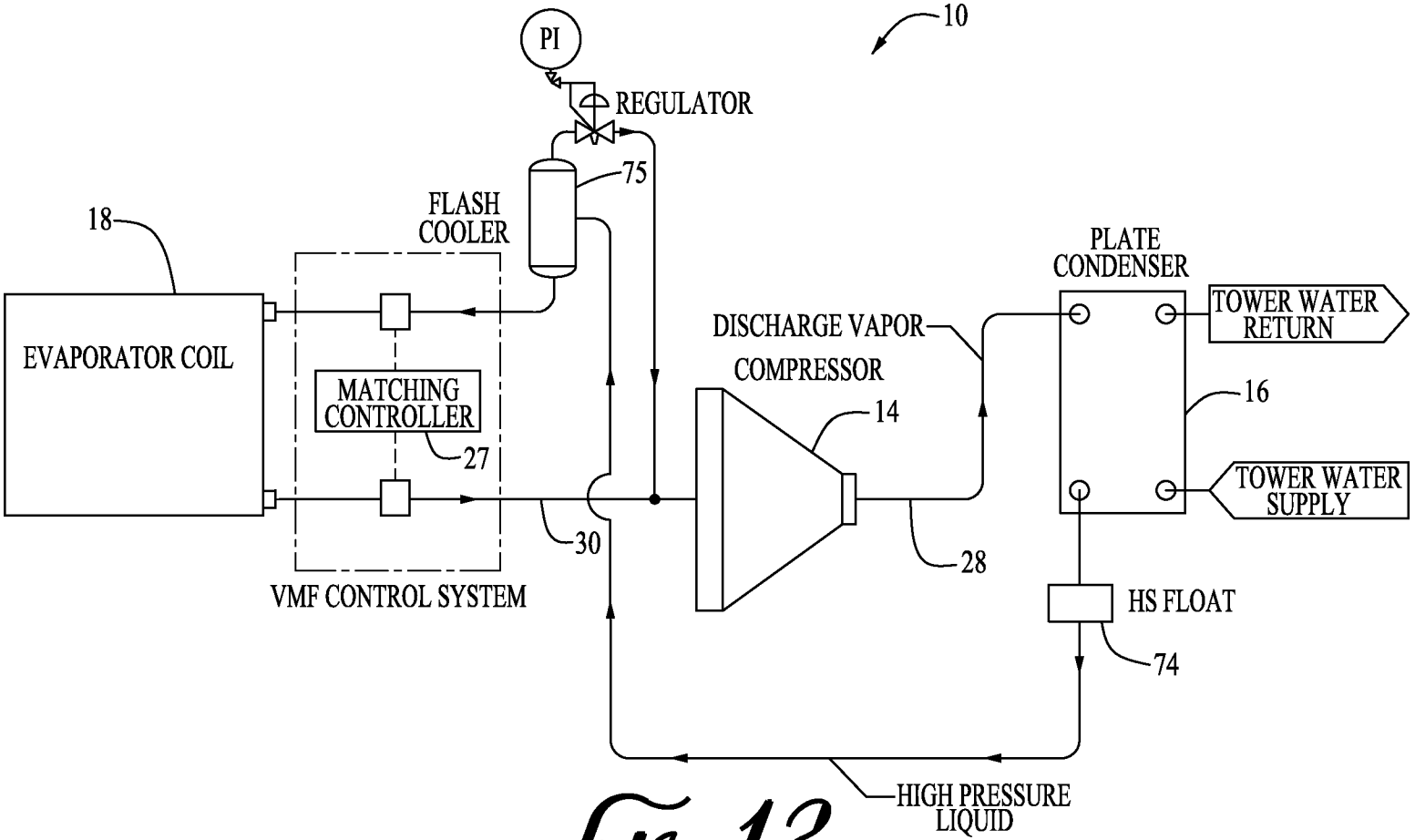
FIG. 12 is a third control diagram for a refrigeration system useable in the invention.

FIG. 12 illustrates a flow scheme applicable for a high-temperature evaporator circuit system. The system illustrated in FIG. 12 is very similar to the system illustrated in FIG. 11, except that no precooler 66 is employed downstream of the condenser 16.

Figure 13:
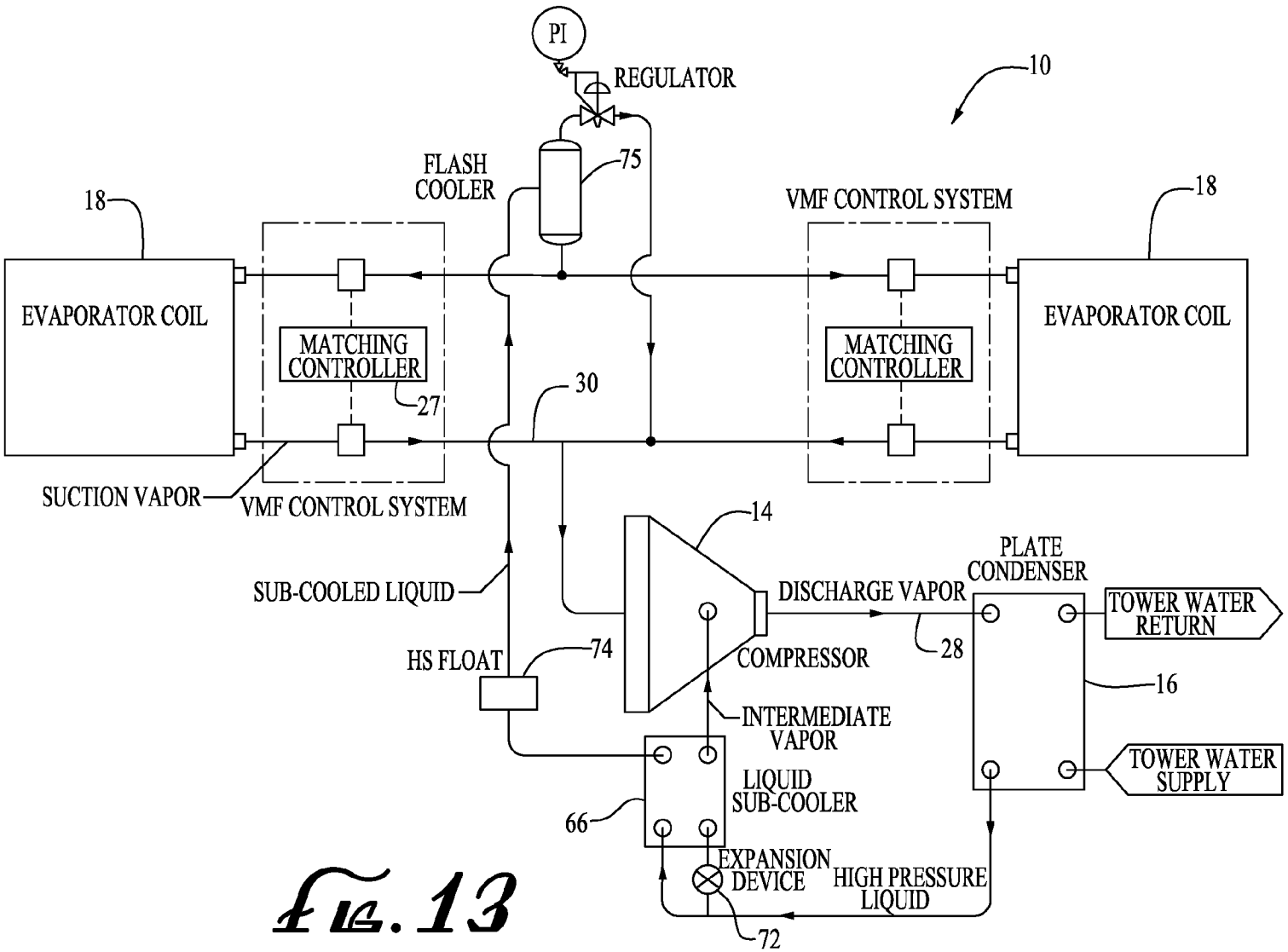
FIG. 13 is a fourth control diagram for a refrigeration system useable in the invention.

FIG. 13 illustrates a flow scheme having multiple evaporators 18 in the system of the invention wherein the input to the evaporators 18 is precooled. The flow scheme illustrated in FIG. 13 is very similar to the flow scheme illustrated in FIG. 11, except that a pair of evaporators 18 are employed.

Figure 14:
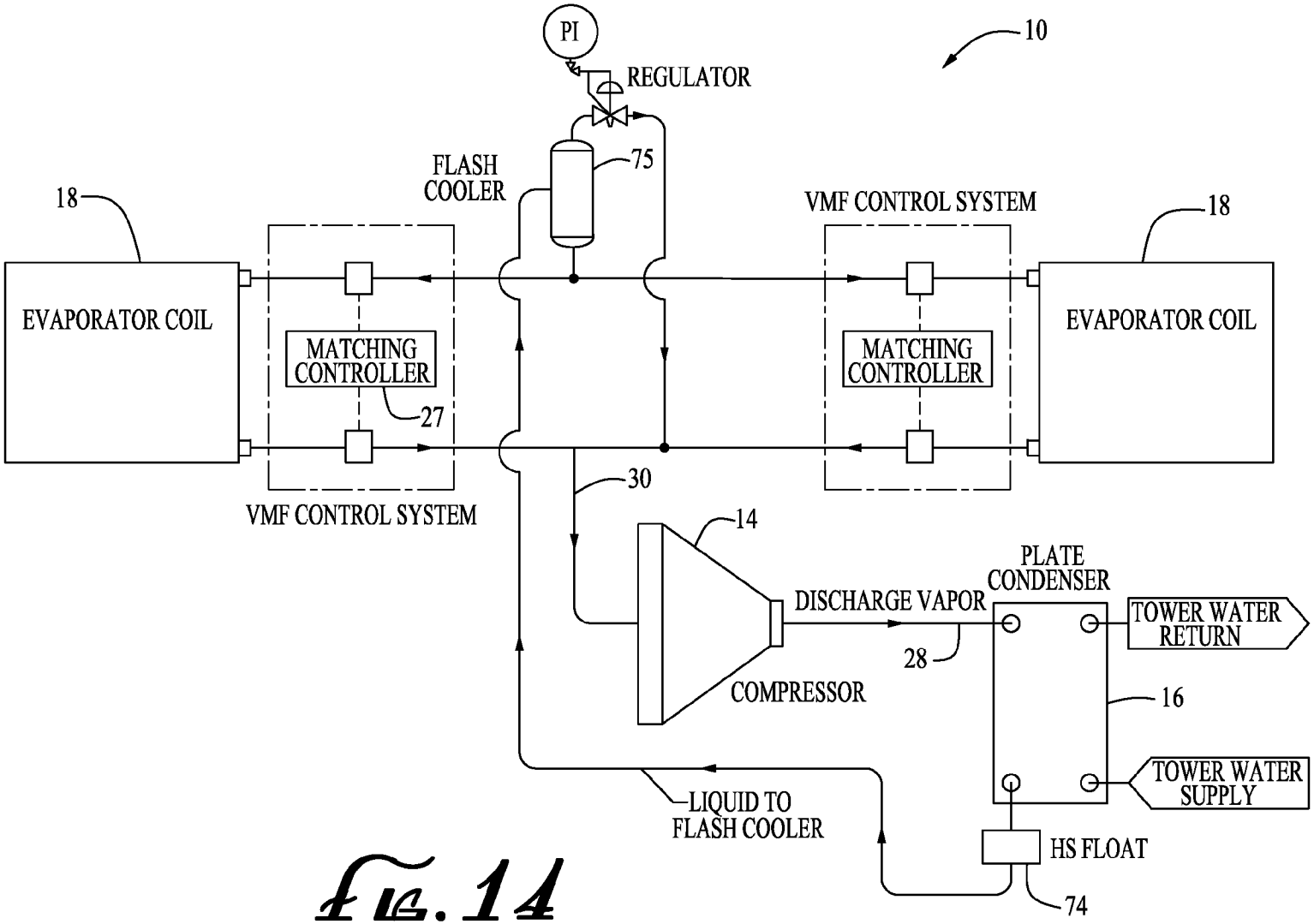
FIG. 14 is a fifth control diagram for a refrigeration system useable in the invention.

FIG. 14 illustrates a flow scheme applicable to a high-temperature evaporator system with multiple evaporators 18. The flow scheme illustrated in FIG. 14 is similar to the flow scheme illustrated in FIG. 13, except that no precooler 66 is employed.

Figure 15:
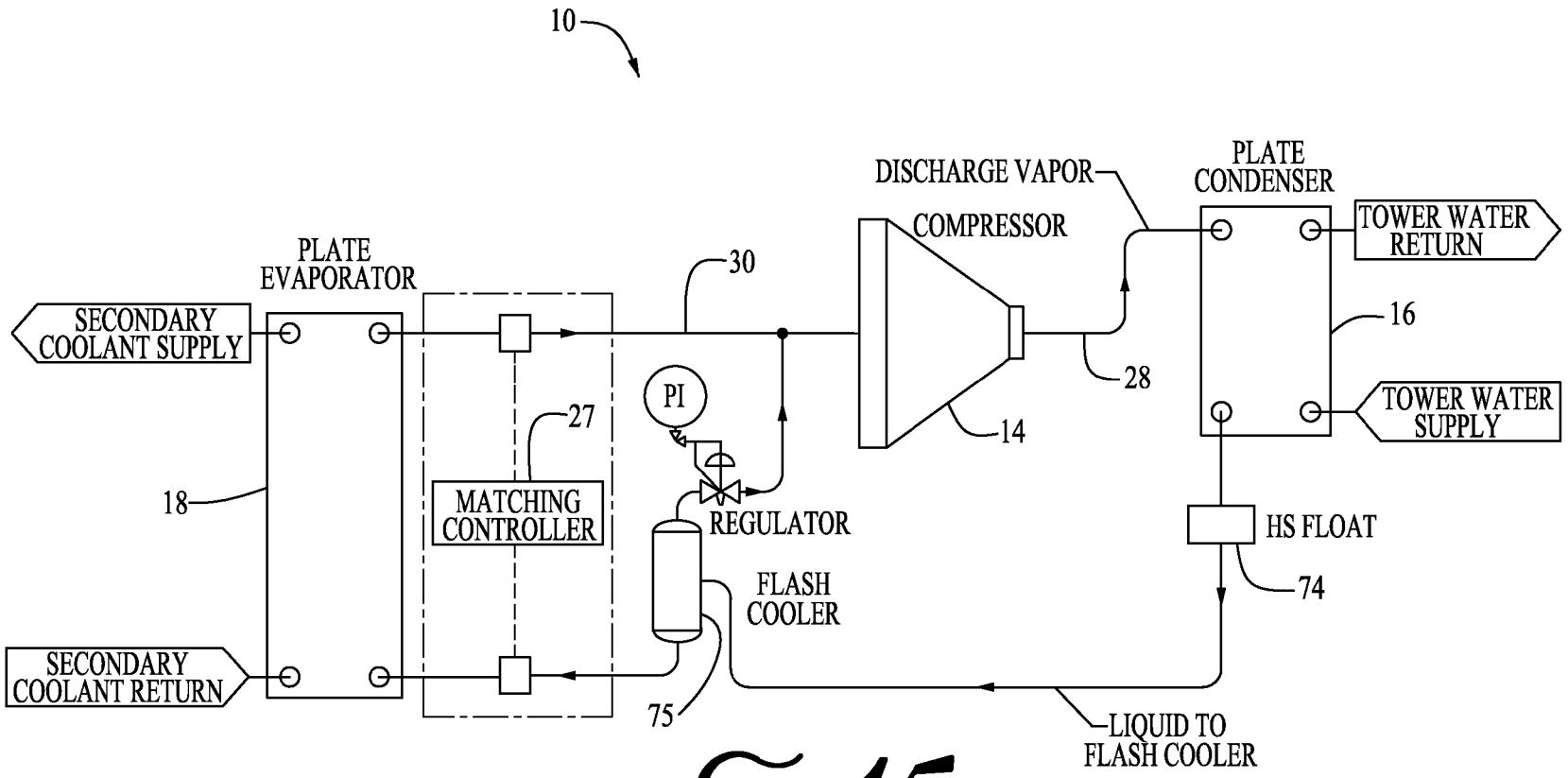
FIG. 15 is a sixth control diagram for a refrigeration system useable in the invention.

FIG. 15 illustrates a flow scheme applicable for a high-temperature system. The flow scheme illustrated in FIG. 15 is very similar to the flow scheme illustrated in FIG. 12, except that a plate evaporator is employed.

Figure 16:
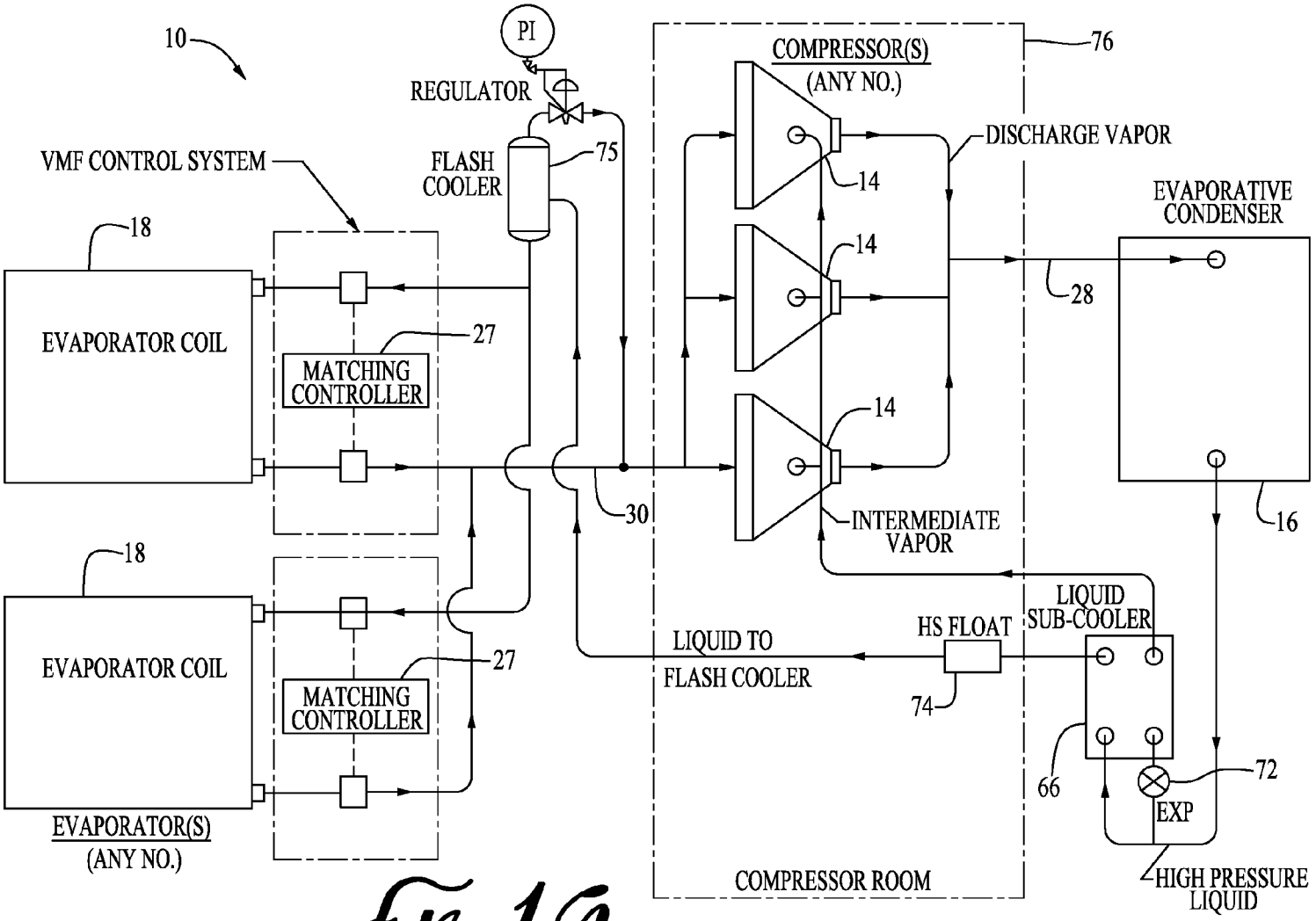
FIG. 16 is a seventh control diagram for a refrigeration system useable in the invention.

FIG. 16 illustrates a flow scheme for a refrigeration system 10 having a large compressor bank 76 disposed within a central compressor room. The flow scheme illustrated in FIG. 16 is very similar to the flow scheme illustrated in FIG. 13, except that multiple compressors 14 are employed.

Figure 17:
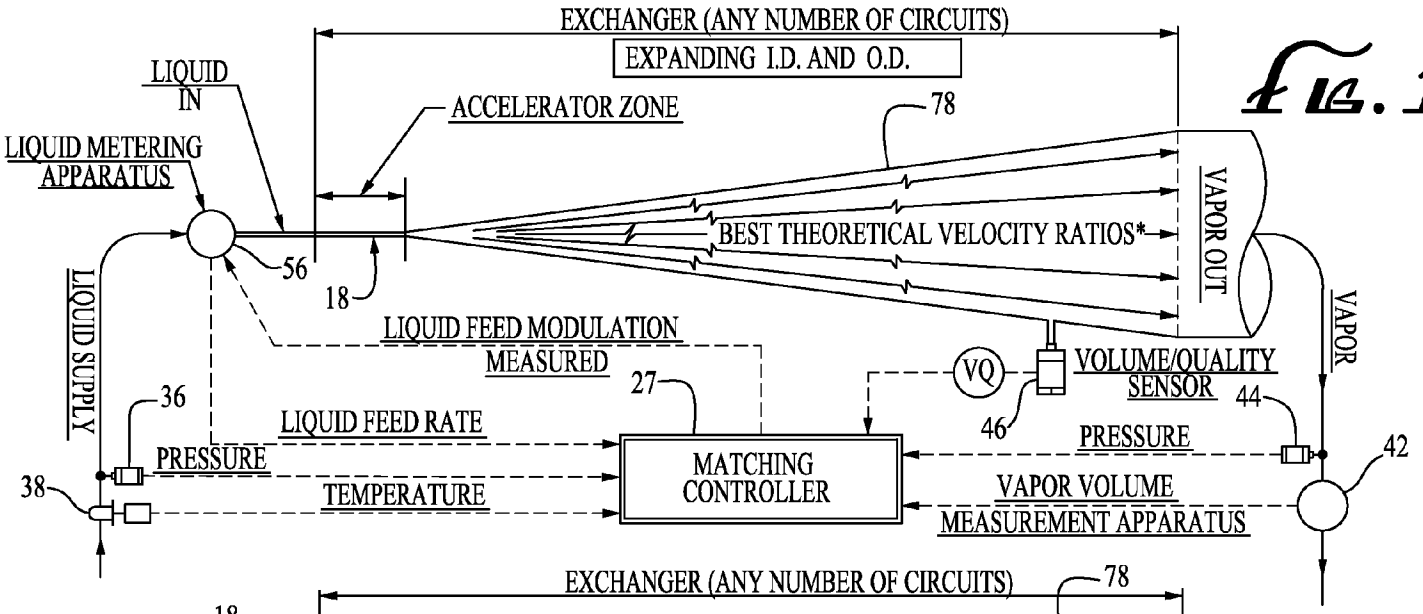
FIG. 17 is a first diagrammatic representation of continuously expanding internal tube dimensions within an evaporator useable in the invention.
Figure 18:
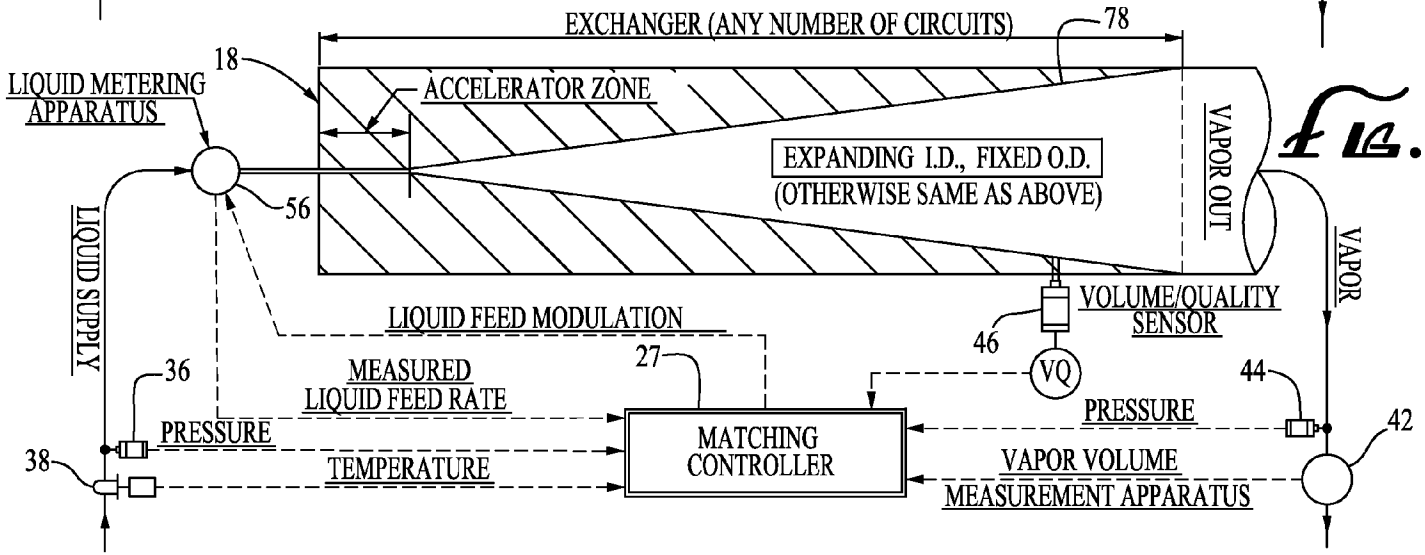
FIG. 18 is a second diagrammatic representation of continuously expanding outer tube dimensions within an evaporator useable in the invention.

As noted above, in many applications, it may be preferable to configure one or more lengths of the circuit tubing 78 within the evaporator 18—most preferably, each length of circuit tubing 78 within the evaporator 18—with an expanding cross-section. Typically, such expansion of the cross-section is smooth and continuous. For example, the evaporator 18 can have one or more lengths of circuit tubing 78 with a first, upstream cross-sectional area and a second, downstream cross-sectional area—the second cross-sectional area being greater than the first cross-sectional area. FIG. 17 illustrates an embodiment of the invention, wherein the circuit tubes within the evaporator 16 expand due to an expanding external diameter, the thickness of the tubing 78 being held fixed. FIG. 18 illustrates an embodiment of the invention wherein the tubes 78 within the evaporator 18 expand due to an expanding internal diameter, the outside diameter being held fixed. The expanding evaporator tubing internal diameter allows for rapid, but reasonably predictable, velocity increases as the refrigerant changes to homogenous, annular, and then mist flow. Liquid puddling is virtually eliminated. As illustrated in FIGS. 17 and 18, an intermediate point refrigerant condition sensor 46 is used to provide input data to the controller 27 at a proactive intermediate control point. Liquid flow, intermediate point condition and exit vapor flow measurements can be triangulated to provide feed control commands for the evaporator, such that the circuit internal surface can remain fully wetted, with little or not refrigerant evaporated outside of the evaporator 18.

In systems comprising expanded evaporator circuits 48, "accelerator" and "preferred velocity" zones are defined in the evaporator 18 which typically include the initial several passes of the evaporator 18. Tube IDs begin comparatively small and increase in size progressively until the maximum ID is reached. Beginning liquid volume to internal surface area in these zones is favorable, even at low temperatures. Puddling and overfeed are virtually eliminated. Design velocities enable vapor-to-liquid ratios and direct vapor quality measurements to be made with relative accuracy. The use of such zones applies to standard OD tubes, mini-tubes, mini-channels and other type exchangers. Refrigeration redistribution, combined with intermediate vapor condition measurements, may be applied with fixed internal cross-section exchangers and larger, more conventional units.

Figure 19:
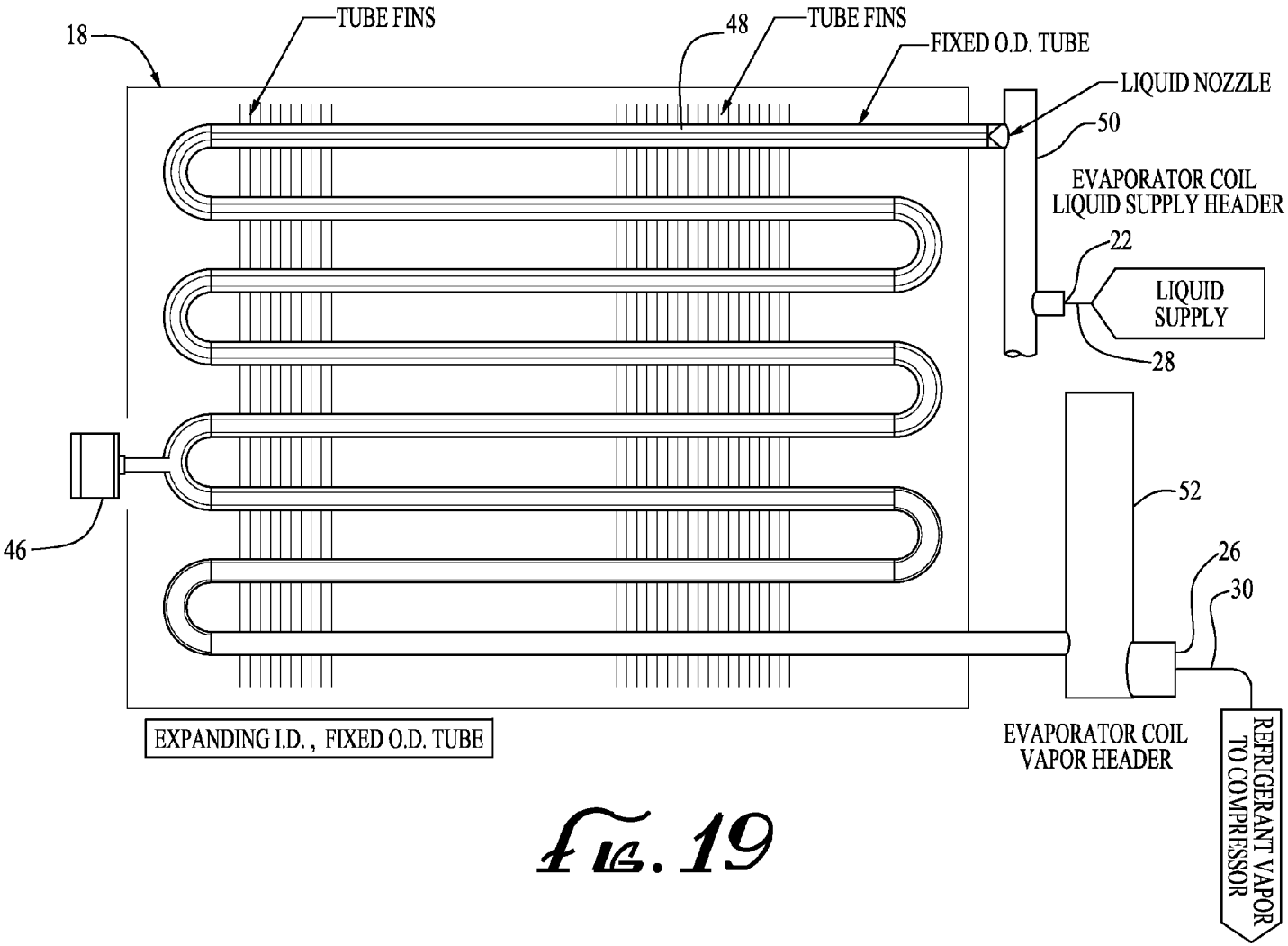
FIG. 19 is a diagrammatic representation of an evaporator useable in the invention having variable internal tube diameters.
Figure 20:
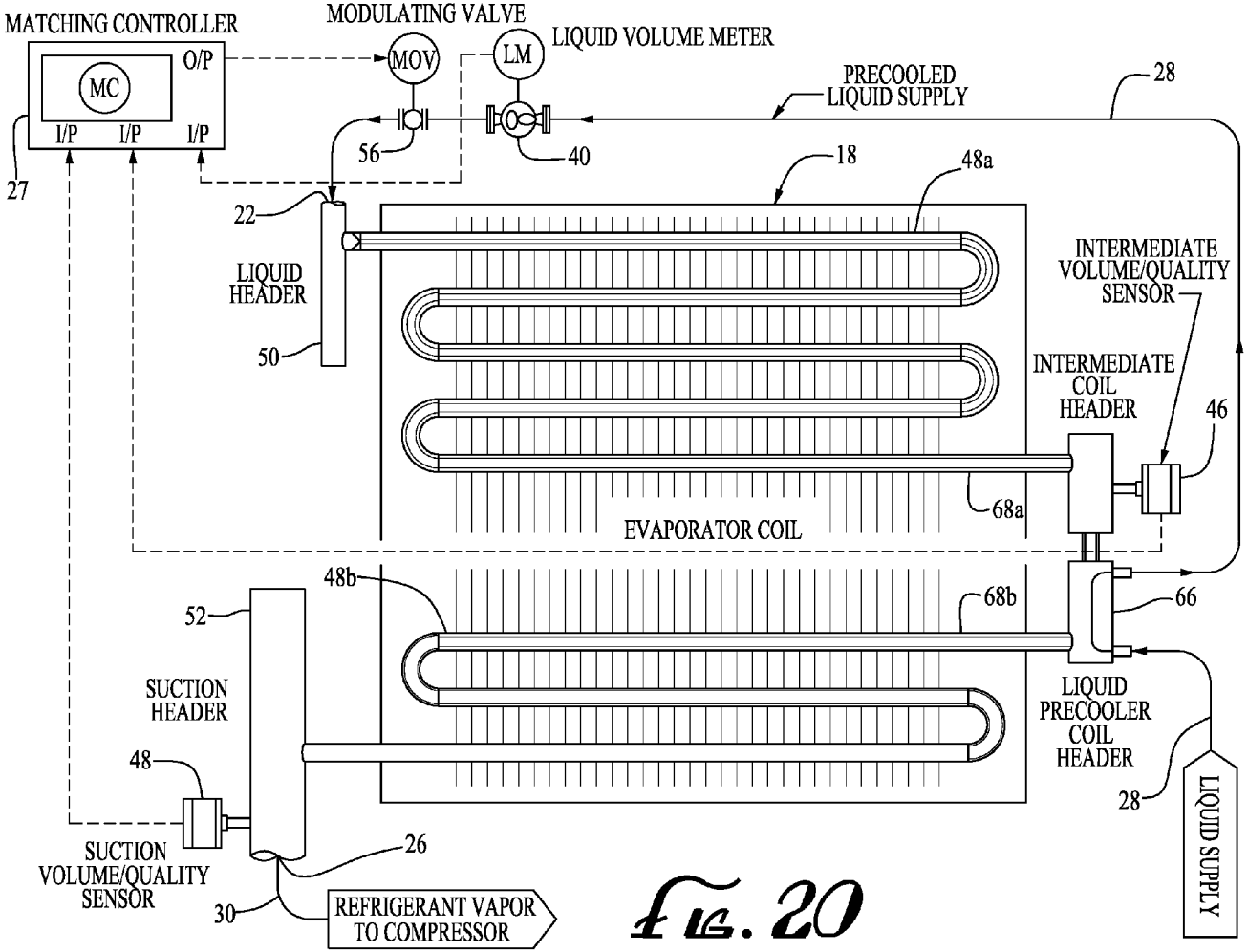
FIG. 20 illustrates an evaporate circuit usable in the invention having tubes with expanding internal diameter, a liquid header and a vapor header.

FIGS. 19 and 20 illustrate embodiments of the invention with expanding evaporator tube cross-sections. FIG. 20 illustrates the method of the invention carried out with first midsection header 68*a* which collects individual circuit flows and blends the two phase mixtures of the individual circuits 48 for weighted measurement of vapor condition at an intermediate point. The condition of the refrigerant at the intermediate point is provided to the controller 27 for use in controlling the flow rate of liquid refrigerant to the evaporator 18. As illustrated in FIG. 20, the blended flow of refrigerant is distributed downstream of the first midsection header 68*a* through a second midsection header 68*b* and includes liquid precooling heat exchange and then is routed back to the downstream section 24 of the evaporator 18. The controller 27 output provides commands for liquid feed modulation calculated to fully wet the coils' internal surface. Little or no refrigerant is evaporated outside of the evaporator 18.

EXAMPLE

A theoretical example of the use of the refrigerant system is provided as follows:

Evaporator outlet suction vapor at a pressure of about 3.25 psig travels to the compressor. The pressure of the evaporator outlet suction is sensed by the pressure transducer. After being compressed to a higher pressure of about 150 psig in the compressor, the vapor is supplied to the condenser through the high-pressure conduit. The high-pressure vapor is condensed in the condenser, typically using cooling tower water. Warm, high-pressure liquid of about 84° F. is supplied from the condenser via the high-pressure conduit to the precooler wherein the liquid refrigerant is cooled to about −17° F.

Precooled liquid at the pressure of the precooled liquid leaving the precooler is sensed by the pressure transducer. The temperature of the precooled liquid leaving the precooler is sensed by the temperature sensor. The liquid volume flow rate is measured by the liquid volume meter 40. The feed rate to the evaporator is modulated by the motor operated control valve. The liquid feed nozzles assure uniform liquid feed rates to any number of evaporator circuits. Little or no flash vapor is generated between the liquid feed modulating valve and the feed nozzles.

Liquid enters the evaporator coil and flows into the first of a number of accelerator zones or passes. The refrigerant within the evaporator boils at a temperature of about −20° F. producing a comparatively large amount of vapor as compared to the liquid volume. The initial pass of the evaporator has a small internal diameter. Liquid volume to the internal surface area of this initial pass is favorable for full wetting of the surface and for good heat transfer. Following accelerator and preferred velocity zones or passes having progressively larger internal diameters. Under load, two-phase liquid and vapor flow accelerates to the desired flow regime. It is noted that liquid flash vapor is reduced in the flow, and the design flow velocity is developed with very little volume and with reasonable pressure drop. At the intermediate or later portion of the circuit, the two-phase flow moves into the mist flow regime.

The flow from any number of circuits move into the intermediate header with the precooling heat exchanger, wherein it cools the warm liquid from the condenser. The entire two-phase evaporating flow leaves the intermediate header and moves to the redistribution header. At an intermediate point, two-phase quality is measured. Two-phase flow leaving the redistribution header travels uniformly to all circuits and at least one remaining pass, wherein the mist burns out forming single-phase vapor flow at the outlet of the evaporator. The evaporator outlet vapor volume is measured by a suction vapor sensor. The controller receives input signal from the volume sensors, pressure transducers and temperature sensor. Vapor quality at the intermediate point is calculated and the liquid feed control is given feed control commands to match the amount of liquid required for the evaporator to operate with fully wetted internal surface and with no liquid remaining at the outlet.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A method of controlling a refrigeration system, wherein the refrigeration system comprises a refrigerant disposed within a fluid-tight circulation loop including a compressor, a condenser and an evaporator comprising one or more evaporator tubes, the refrigerant being capable of existing in a liquified state, a gaseous state and a two-phase state comprising both refrigerant in the liquified state and refrigerant in the gaseous state, the evaporator having an upstream section with an inlet opening and a downstream section with an outlet opening, the method comprising:

(a) compressing refrigerant in a gaseous state within the compressor and cooling the refrigerant within the condenser to yield refrigerant in a liquified state;

(b) flowing the refrigerant in a liquified state into the evaporator;

(c) reducing the pressure of the refrigerant within the evaporator to yield refrigerant in a two-phase state;

(d) reducing the pressure of the refrigerant in a two-phase state within the evaporator to yield a refrigerant in a gaseous state;

(e) flowing refrigerant in a gaseous state from the evaporator to the compressor;

(f) repeating steps (a)-(e);

(g) measuring the ratio of the measured volume of vapor to the volume of liquid in refrigerant in a two-phase state with a refrigerant condition sensor disposed within the evaporator upstream of the outlet opening and downstream of the inlet opening; and (h) controlling the flow rate of refrigerant to the evaporator in step (b) based upon the measured ratio from step (g) to a flow rate required to wet at least most of the entire surface of the evaporator tubes.

2. The method of claim 1 wherein the controlling of the flow of refrigerant in a liquid state to the evaporator in step (h) is based upon the measured quality of the refrigerant within the evaporator.

3. The method of claim 1 wherein the measured condition of the refrigerant within the evaporator upstream of the outlet opening in step (g) is the measured condition of the refrigerant at an intermediate point within the evaporator.

4. The method of claim 1 wherein the measured condition of the refrigerant within the evaporator upstream of the outlet opening in the step (g) is the calculated condition of the refrigerant at an interpolation of the measured conditions of the refrigerant at a pair of intermediate points within the evaporator.

5. The method of claim 1 wherein refrigerant in a liquified state from step (a) is precooled prior to being flowed into the evaporator in step (b).

6. The method of claim 5 wherein refrigerant in a liquified state from step (a) is precooled to 0° F. to 60° F. of its boiling point at the pressure of the refrigerant at the inlet opening of the evaporator.

7. The method of claim 5 wherein refrigerant in a liquified state from step (a) is precooled to 0° F. to 30° F. of its boiling point at the pressure of the refrigerant at the inlet opening of the evaporator.

8. The method of claim 5 wherein refrigerant in a liquified state from step (a) is precooled to 0° F. to 5° F. of its boiling point at the pressure of the refrigerant at the inlet opening of the evaporator.

9. The method of claim 5 wherein the evaporator comprises tubing, an inlet, and an outlet, and the method comprises the additional steps of (i) removing refrigerant from the evaporator tubing between the inlet and the outlet, (ii) precooling refrigerant from step (a) with the removed refrigerant, and (iii) introducing the removed refrigerant back into the evaporator tubing at a location downstream from the location from which the refrigerant was removed.

10. The method of claim 1 wherein the measured condition of the refrigerant in step (g) is determined from refrigerant drawn from the evaporator, and wherein refrigerant in a liquified state from step (a) is precooled by thermal contact with refrigerant flowing within the evaporator.

11. The method of claim 1 wherein the upstream section of the evaporator comprises one or more lengths of tubing each having an upstream first cross-sectional area and a second downstream cross-sectional area, the second cross-sectional area being greater than the first cross-sectional area, the expansion in cross-sectional area between the first circular cross-sectional area and the second circular cross-sectional area being smooth and continuous.

12. The method of claim 1 wherein the upstream section of the evaporator comprises a plurality of upstream circuits and the downstream section comprises a plurality of downstream circuits, and wherein a plurality of the upstream circuits are connected to a plurality of the downstream circuits by a midsection header.

13. The method of claim 12 wherein the control of flow of refrigerant in a liquid state to the evaporator is based upon the measured condition of the refrigerant within the midsection header.

14. A refrigeration system comprising:

(a) a fluid tight circulation loop including a compressor, a condenser and an evaporator, the circulating loop being configured to continuously circulate a refrigerant which is capable of existing in a liquified state, a gaseous state and a two-phase state comprising both refrigerant in the liquified state and refrigerant in the gaseous state, the evaporator having one or more evaporator tubes, an upstream section with an inlet opening and a downstream section with an outlet opening, the circulation loop being further configured to (i) compress refrigerant in a gaseous state within the compressor and cool the refrigerant in the condenser to yield refrigerant in a liquified state; (ii) flow the refrigerant in a liquified state into the evaporator; (iii) reduce the pressure of the refrigerant within the evaporator to yield refrigerant in a two-phase state; (iv) reduce the pressure of the refrigerant in a two-phase state within the evaporator to yield a refrigerant in a gaseous state; (v) flow refrigerant in a gaseous state from the evaporator to the compressor; and (vi) repeat steps (i)-(v);

(b) a refrigerant condition sensor disposed within the evaporator upstream of the outlet opening and downstream of the inlet opening to sense the ratio of the measured volume of vapor to the volume of liquid in refrigerant in a two-phase state within the evaporator; and (c) a controller for controlling the flow of refrigerant in a liquid state to the evaporator based upon the ratio of the measured volume of vapor to the volume of liquid in refrigerant in a two-phase state, so that the flow rate of refrigerant to the evaporator can be controlled to a flow rate required to wet at least most of the entire surface of the evaporator tubes.

15. The refrigeration system of claim 14 wherein the measured condition of the refrigerant employed by the controller to control the flow of refrigerant to the evaporator is the measured quality of the refrigerant at an intermediate point within the evaporator.

16. The refrigeration system of claim 14 wherein the condition of the refrigerant employed by the controller to control the flow of refrigerant to the evaporator is the calculated condition of refrigerant at an interpolation of the measured conditions of the refrigerant at a pair of intermediate points within the evaporator upstream of the outlet opening.

17. The refrigeration system of claim 14 further comprising an internal precooler for precooling refrigerant flowed into the evaporator.

18. The refrigeration system of claim 17 wherein the precooler is capable of cooling refrigerant to within 0° F. to 30° F. of its boiling point at the pressure of the refrigerant at the inlet opening of the evaporator.

19. The refrigeration system of claim 17 wherein the controller is adapted to determine the condition of the refrigerant drawn from the evaporator, and wherein refrigerant in a liquified state from step (a) is precooled by thermal contact with refrigerant flowing within the evaporator.

20. The refrigeration system of claim 14 wherein the upstream section of the evaporator comprises one or more lengths of tubing each having a first cross-sectional area, and wherein the downstream section comprises one or more lengths of tubing, each having a second cross-sectional area which is greater than the first cross-sectional area, the expansion in cross-sectional area between the first circular cross-sectional area and the second circular cross-sectional area being smooth and continuous.

21. The refrigeration system of claim 14 wherein the upstream section of the evaporator comprises a plurality of upstream circuits and the downstream section comprises a plurality of downstream circuits, and wherein a plurality of the upstream circuits are connected to a plurality of the downstream circuits by a midsection header.

22. The refrigeration system of claim 21 wherein the control of flow of refrigerant in a liquid state to the evaporator is based upon the measured condition of the refrigerant measured within the midsection header.

23. The refrigeration system of claim 14 comprising no equipment for removing liquid refrigerant from the circulation loop flowing between the evaporator and the compressor.

24. The system of claim 14 comprising (i) evaporator tubing as part of the evaporator, (ii) an evaporator header for receiving refrigerant, the evaporator header being between the inlet opening and the outlet opening, (iii) a precooler for precooling refrigerant flowed into the evaporator with refrigerant in the evaporator header, and (iv) a connection for passing the refrigerant used for precooling back into the tubing.

25. A method of controlling a refrigeration system, wherein the refrigeration system comprises a refrigerant disposed within a fluid-tight circulation loop including a compressor, a condenser and an evaporator comprising one or more evaporator tubes, the refrigerant being capable of existing in a liquefied state, a gaseous state and a two-phase state comprising both refrigerant in the liquefied state and refrigerant in the gaseous state, the evaporator having an upstream section with an inlet opening and a downstream section with an outlet opening, the method comprising the steps of:

(a) compressing refrigerant in a gaseous state within the compressor and cooling the refrigerant within the condenser to yield refrigerant in the liquefied state;

(b) flowing refrigerant from the condenser into the evaporator, wherein the refrigerant partially exists in a two-phase state;

(c) flowing refrigerant from the evaporator to the compressor;

(d) repeating steps (a)-(c);

(e) measuring the ratio of the measured volume of vapor to the volume of liquid in refrigerant in a two-phase state with a refrigerant condition sensor disposed within the evaporator upstream of the outlet opening and downstream of the inlet opening; and (f) controlling the flow rate of refrigerant to the evaporator in step (b) based upon the measured ratio from step (e) to a flow rate required to wet at least most of the entire surface of the evaporator tubes;

wherein refrigerant in a liquified state from step (a) is precooled prior to being flowed into the evaporator in step (b); and wherein a plurality of the upstream circuits are connected to a plurality of the downstream circuits by a midsection header.

26. The method of claim 25 wherein the evaporator comprises tubing, an inlet, and an outlet, and the method comprises the additional steps of (i) removing refrigerant from the evaporator coil at a location between the inlet and the outlet, (ii) precooling refrigerant flowing from the condenser into the evaporator with the removed refrigerant, and (iii) introducing the removed refrigerant back into the evaporator tubing at a location downstream from the location from which the refrigerant was removed.

27. A method for cooling a refrigerant comprising the steps of:

(a) compressing refrigerant in a gaseous state within a compressor and cooling the refrigerant within a condenser to yield refrigerant in a liquefied state;

(b) flowing refrigerant from the condenser into an evaporator comprising one or more evaporator tubes;

(c) flowing refrigerant from the evaporator to the compressor;

(d) repeating steps (a)-(c);

(e) measuring the ratio of the measured volume of vapor to the volume of liquid in refrigerant in a two-phase state with a refrigerant condition sensor disposed within the evaporator upstream of the outlet opening; and (f) controlling the flow rate of refrigerant to the evaporator in step (b) based upon the measured ratio from step (e) to a flow rate required to wet at least most of the entire surface of the evaporator tubes.

28. The method of claim 27 wherein the measured condition of the refrigerant within the evaporator upstream of the outlet opening in the step (e) is the calculated condition of the refrigerant at an interpolation of the measured conditions of the refrigerant at a pair of intermediate points within the evaporator.

29. The method of claim 27 wherein the upstream section of the evaporator comprises one or more lengths of tubing each having an upstream first cross-sectional area and a second downstream cross-sectional area, the second cross-sectional area being greater than the first cross-sectional area, the expansion in cross-sectional area between the first circular cross-sectional area and the second circular cross-sectional area being smooth and continuous.

30. The method of claim 27 wherein the evaporator comprises tubing, an inlet, and an outlet, and the method comprises the additional steps of (i) removing refrigerant from the evaporator tubing at a location between the inlet and the outlet, (ii) precooling refrigerant flowing from the condenser into the evaporator with the removed refrigerant, and (iii) introducing the removed refrigerant back into the evaporator tubing at a location downstream from the location from which the refrigerant was removed.

* * * * *